US006991040B2

(12) United States Patent
Hill, Jr. et al.

(10) Patent No.: US 6,991,040 B2
(45) Date of Patent: Jan. 31, 2006

(54) METHOD AND APPARATUS FOR LOCKING OUT A SUBSURFACE SAFETY VALVE

(75) Inventors: Thomas G. Hill, Jr., Kingwood, TX (US); Thomas Michael Deaton, Houston, TX (US); Neil A. A. Simpson, Aberdeen (GB); Rory L. Hodge, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 202 days.

(21) Appl. No.: 10/600,037

(22) Filed: Jun. 20, 2003
(Under 37 CFR 1.47)

(65) Prior Publication Data

US 2004/0007365 A1 Jan. 15, 2004

Related U.S. Application Data

(60) Provisional application No. 60/395,521, filed on Jul. 12, 2002.

(51) Int. Cl.
*E21B 34/06* (2006.01)

(52) U.S. Cl. ..... 166/373; 166/323; 166/332.4; 166/332.8; 166/386

(58) Field of Classification Search ..... 166/373, 166/384, 386, 323, 332.1, 332.4, 332.8
See application file for complete search history.

(56) References Cited

U.S. PATENT DOCUMENTS

| | | | | |
|---|---|---|---|---|
| 1,358,818 | A | 11/1920 | Bering | |
| 2,280,769 | A | 4/1942 | Page | 51/184.1 |
| 3,059,708 | A | 10/1962 | Cannon et al. | 175/393 |
| 3,145,790 | A | 8/1964 | Bridwell et al. | 175/409 |
| 3,195,636 | A | 7/1965 | Cordary et al. | 166/55.8 |
| 3,331,439 | A | 7/1967 | Sanford | 166/55.8 |
| 3,696,868 | A | 10/1972 | Taylor, Jr. | 166/315 |
| 3,786,865 | A | 1/1974 | Tausch et al. | 166/224 S |
| 3,786,866 | A | 1/1974 | Tausch et al. | 166/224 S |
| 3,799,258 | A | 3/1974 | Tausch | 166/224 S |
| 3,859,877 | A | 1/1975 | Sherer et al. | 82/82 |
| 3,911,707 | A | 10/1975 | Minakov et al. | 72/76 |

(Continued)

FOREIGN PATENT DOCUMENTS

EP 0266864 A2 5/1988

(Continued)

OTHER PUBLICATIONS

PCT Search Report, International Application No. PCT/GB 03/02960, dated Oct. 1, 2003.
U.K. Office Action, Application No. GB0502847.7, dated May 20, 2005.

*Primary Examiner*—Zakiya Walker
(74) *Attorney, Agent, or Firm*—Patterson & Sheridan LLP

(57) ABSTRACT

A lockout tool dimensioned to be received within a housing of a subsurface safety valve (SSV). The lockout tool generally comprises an elongated housing, and an expander mandrel slidably received within the housing. Together, the elongated housing and expander mandrel are run into the wellbore and landed into the housing of the SSV such that the end of the expander mandrel opens the flapper valve. A portion of the lookout tool housing shoulders against the flow tube in the SSV to drive the flow tube downward, thereby maintaining the flapper of the SSV in its open position. As the expander mandrel moves downward through the hard scat of the SSV, the mandrel engages the flow tube and expands it against the hard seat. In this manner, the flow tube is expanded into permanent, frictional engagement with the hard seat. This, in turn, looks the flapper member of the SSV in its open position.

37 Claims, 25 Drawing Sheets

U.S. PATENT DOCUMENTS

| | | | | |
|---|---|---|---|---|
| 4,125,013 | A | 11/1978 | Nicolas et al. | 73/151 |
| 4,550,781 | A | 11/1985 | Kagler, Jr. | 166/340 |
| 4,574,889 | A | 3/1986 | Pringle | 166/386 |
| 4,577,694 | A | 3/1986 | Brakhage, Jr. | 166/382 |
| 4,624,315 | A | 11/1986 | Dickson et al. | 166/323 |
| 4,842,082 | A | 6/1989 | Springer | 175/279 |
| 4,944,351 | A | 7/1990 | Eriksen et al. | 166/376 |
| 4,981,177 | A | 1/1991 | Carmody et al. | 166/376 |
| 5,129,322 | A | 7/1992 | Christopher et al. | 102/202.3 |
| 5,201,817 | A | 4/1993 | Hailey | 175/269 |
| 5,249,630 | A | 10/1993 | Meaders et al. | 166/373 |
| 5,253,714 | A | 10/1993 | Davis et al. | 166/376 |
| 5,496,044 | A | 3/1996 | Beall et al. | 277/1 |
| 5,598,864 | A | 2/1997 | Johnston et al. | 137/68.16 |
| 5,799,949 | A | 9/1998 | Beall et al. | 277/1 |
| 6,059,041 | A | 5/2000 | Scott | 166/373 |
| 6,352,118 | B1 | 3/2002 | Dickson et al. | 166/373 |
| 2002/0150436 | A1 | 10/2002 | Mason et al. | 409/143 |

FOREIGN PATENT DOCUMENTS

| | | |
|---|---|---|
| EP | 0266864 A3 | 5/1989 |
| EP | 0 892 148 | 1/1999 |
| EP | 0266864 B2 | 7/2000 |
| EP | 1241321 A2 | 9/2002 |
| EP | 1241321 A3 | 1/2003 |
| GB | 2172320 | 9/1986 |
| WO | WO 02/31315 | 4/2002 |

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION D-D

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION E-E

SECTION B-B

SECTION C-C

SECTION D-D

SECTION E-E

METHOD AND APPARATUS FOR LOCKING OUT A SUBSURFACE SAFETY VALVE

RELATED APPLICATIONS

This new application for letters patent claims priority from an earlier-filed provisional patent application entitled "Method and Apparatus for Locking Out a Subsurface Safety Valve." That application was filed on Jul. 12, 2002 and was assigned Application No. 60/395,521.

BACKGROUND OF THE INVENTION

1. Field of the Invention

This invention is related generally to safety valves. More particularly, this invention pertains to subsurface safety valves deployed in a wellbore for controlling fluid flow through a production tubing string. More particularly still, the present invention relates to a lockout tool for locking out a safety valve into its open position.

2. Description of the Related Art

Subsurface Safety Valves (SSVs) are often deployed in hydrocarbon producing wells to shut off production of well fluids in emergency situations. Such SSVs are typically fitted into production tubing in the wellbore, and operate to block the flow of formation fluids upwardly through the production tubing should a failure or hazardous condition occur at the well surface.

SSVs are designed either to be slickline retrievable, or tubing retrievable. If a safety valve is configured to be slickline/wireline retrievable (WRSSV), it can be easily removed and repaired. If the SSV forms a portion of the well tubing, it is commonly known as "tubing retrievable" (TRSSV). In this instance, the production tubing string must be removed from the well to perform any safety valve repairs.

The subsurface safety valve has a flapper member or "plate," that is moveable between an open position and a closed position. In this respect, the flapper member is typically pivotally mounted to mate with a hard seat. When the flapper is in its open position, it is held in a position where it pivots away from the hard seat, thereby opening the bore of the production tubing. However, the flapper is biased to its closed position against the seat.

The flapper of the safety valve is held open during normal production operations. This is done by the application of hydraulic fluid pressure transmitted to an actuating mechanism. A common actuating mechanism is a cylindrical flow tube, which is maintained in a position adjacent the flapper by hydraulic pressure supplied through a control line. The control line resides within the annulus between the production tubing and the well casing. Pressurized hydraulic fluid is delivered from the surface through the control line, and bears against a piston. The piston, in turn, acts against the cylindrical flow tube, which in turn moves across the flapper valve to hold the valve open. When a catastrophic event occurs at the surface, hydraulic pressure is interrupted, causing the cylindrical flow tube to retract, and allowing the safety valve to quickly close. When the safety valve closes, it blocks the flow of production fluids up the tubing. Thus, the SSV provides automatic shutoff of production flow in response to well safety, conditions that can be sensed and/or indicated at the surface. Examples of such conditions include a fire on an offshore platform, sabotage to the well at the earth surface, a high/low flow line pressure condition, a high/low flow line temperature condition, and operator override.

Removal and repair of the tubing retrievable safety valve is costly and time consuming. It is usually advantageous to delay the repair of the TRSSV yet still provide the essential task of providing well safety for operations personnel while producing from the well. To accomplish these objectives; the safety valve is disabled in the open position, or "locked out". This means that the flapper member is pivoted and permanently held in the fully opened position. In normal circumstances, if the well is to be left in production, a WRSSV may be inserted in the well, often in lockable engagement inside a bore within the locked out tubing retrievable safety valve. Because of the insertion relationship, the WRSSV necessarily has a smaller inside diameter than the TRSSV, thereby reducing the potential hydrocarbon production rate from the well. Locking out the safety valve will not eliminate a need for remediation later, but the lockout and use of the WRSSV will allow the well to stay on production (most often, with a reduced production rate) or perform other work functions in the tubing until the TRSSV can be repaired or replaced.

Various types of mechanical lockouts have been proposed. Examples are found in U.S. Pat. Nos. 3,696,868; 3,786,865; and 3,786,866. In these applications, various additional parts are necessary to enable the valve to be locked out. Such parts are integral to each and every valve. It is interesting to note that modern SSVs are extraordinarily reliable, and such lockout mechanisms are not used except in a small fraction of the total valve population; yet, integral lockout mechanisms are present in, and add unnecessary cost to, most prior art SSV assemblies. Further, integral lockout mechanisms are not normally operated for extended periods of time, often for years, and are not normally or even periodically actuated. For these reasons, the integral lockout mechanisms may themselves fail to work for various reasons such as sand, corrosion, scale and asphaltine buildup.

Other inventors have realized the disadvantages of integral lockout mechanisms, and inventions have been disclosed in U.S. Pat. No. 4,574,889 (Pringle '889), U.S. Pat. No. 4, 577,694 (Brakage, Jr. '694) and U.S. Pat. No. 6,059,041 (Scott '041). These inventions recognize a need to remove integral lockout mechanisms and requisite structure from the SSV.

Pringle '889 teaches a method and apparatus of locking out a subsurface safety valve. The apparatus provides a housing having a bore and one downwardly directed shoulder adjacent the bore. The shoulder makes an outward indentation in the flow tube at a predetermined location whereby the indentation will engage a downwardly directed shoulder in the housing, preventing the flow tube from moving to the closed position. The mechanism has the limitation of making only a single indentation during any stroke of the lockout tool. This results in very high localized stresses at the point of impact, causing embrittlement of the material, and possibly undesirably punching through the flow tube. Further, there is no mechanism disclosed to index the punching mechanism to another radial position. Because the SSV assembly is often placed thousands of feet below the earth's surface, using the device taught by Pringle '889 to make second or subsequent indentations in the flow tube in any other radial position is unreliable. Therefore, the operator can only be assured of making a single indentation or, worse, a single penetration of the flow tube. When penetration occurs a metal flap is formed, usually connected by a very small area of metal resembling the infamous "hanging chad" of Florida election lore. A SSV that is locked out in such a manner may not stay locked out when slickline, coiled tubing or other remediation procedures are performed on the well below the SSV. In this respect, when such service tools are pulled up through the locked out SSV, shearing the indentation or flap can occur, resulting in an undesirable unlocking of the valve. Such unlocking can lead to the well again being prematurely shut in, and a resultant loss of production.

Brakage, Jr. '694 teaches a method and apparatus for permanently locking a shiftable valve member in a well conduit in an open position. The invention provides a spring metal band that is adapted to expand from a contracted, run-in position to a radially enlarged locking position. The band thereby holds the valve member in an open position. The band is deposited in the SSV by a specially adapted slickline tool. While this invention satisfies the need to remove the integral lockout from the safety valve, an additional part, (the spring metal band) is introduced into the SSV assembly downhole. Further, after deposition, the metal band is not positively attached to anything inside the SSV, but is held in place only by the frictional force exerted by the spring metal band. Certain flow regimes in the wellbore can collapse the spring metal band and allow it to flow out of the SSV, thereby causing the well to inadvertently shut in. This phenomenon has been observed.

Scott'041 is similar to Brakage Jr. '694 wherein deposition of a radially deflectable blocking member relative to the SSV is provided to enable lockout. In a described embodiment of the apparatus, a lockout tool has mechanisms which effect latching of the tool to an internal profile of a safety valve, displacement of a flow tube of the safety valve to open the safety valve, and deposition of an expandable ring to prevent closure of the safety valve. This invention only partially satisfies the need to remove the integral lockout from the safety valve, because it requires expensive special profiles and again introduces an additional part to enable the lockout. While this is an arguable design improvement over Brakage Jr. '694, certain flow regimes still may flow the radially deflectable blocking member out of the SSV, thereby causing the well to inadvertently shut in.

There is a need, therefore, for a lockout tool that requires no additional integral SSV parts or expensive special profiles to enable lockout of an SSV. Further, there is a need for a lockout tool that can be deployed by slickline or coiled tubing, and does not attempt to permanently deposit any parts in the safety valve to enable lockout. Still further, there is a need for a lockout tool that does not require special profiles or shoulders in the valve, and can be used to lock out virtually any type of safety valve made by any manufacturer.

SUMMARY

The present invention is directed to a method and apparatus of locking out a subsurface well safety valve (SSV) in the open position. The SSV itself includes a housing having a bore, a valve closure member in the bore that is movable between an open position and a closed position, a flow tube axially movable in the housing for selectively moving the valve closure member from its closed position to its open position, and an actuator for translating the flow tube longitudinally, e.g., a spring-biased piston.

The present invention first provides an apparatus that enables a well operator to lock the downhole safety valve into its open position. A lockout tool is provided that is dimensioned to be received within the housing of the safety valve. The lockout tool first comprises a stem. The stem connects the lockout tool to a run-in tool, such as a slickline. The lockout tool also comprises an elongated housing. The housing includes a ball housing portion that houses a plurality of radially disposed balls. Next, the lockout tool comprises an expander mandrel. The expander mandrel is connected to the lower end of the stem by means of a stem extension member. The expander mandrel is received within the housing of the lockout tool.

A method for "locking out" the safety valve is also provided. In operation, the lockout tool is landed into the housing of an SSV such that the balls are adjacent a non-movable member in the SSV, e.g., the hard seat. The lockout apparatus includes, in one aspect, a set of flow tube dogs and a set of locking dogs. These dogs are disposed intermediate the stem and the housing of the lockout tool. When the stem (and attached expander mandrel) are run into the SSV, the flow tube dogs are landed on top of the flow tube, while the locking dogs are positioned adjacent an internal recess in the SSV housing. As the expander mandrel is urged downward, the locking dogs move radially outward, fixing the lockout tool in the SSV housing. Further movement still of the mandrel extends the flow tube dogs into contact with the flow tube. Still further movement of the mandrel moves the flow tube downward, thereby opening the flapper member.

The balls in the ball housing are at a depth adjacent the safety valve's hard seat. The expander mandrel is urged further downwardly relative to both the lockout tool housing and the safety valve housing. The expander mandrel includes an enlarged diameter portion. As the expander mandrel is moved downward within the SSV, the enlarged outer diameter portion of the mandrel system engages the balls, forcing them radially outward. The balls, in turn, contact the flow tube and expand the flow tube into permanent, radial and frictional engagement with the hard seat. The flapper member of the SSV is thereby locked in its open position, preventing the flow tube from returning to the closed position.

In summary, the method of the present invention in one aspect includes the steps of lowering the lockout tool in a well, locating in the SSV to be locked out, locking the tool in position, moving the flow tube downward thereby opening the flapper member, and from the inside of the bore, outwardly expanding a portion of the flow tube's circumference at a predetermined location whereby the expanded portion firmly engages a non-moveable portion in the housing of the SSV, thereby preventing the flow tube from returning to the closed position. After locking out the safety valve, the lockout tool of the present invention is removed from the well. A result of the expansion operation is engagement between the expanded portion of the flow tube and the non-moveable parts in the safety valve, thereby causing a very high friction force therebetween. The expansion force may also slightly expand the non-moveable metallic parts behind the flow tube, thereby forming an in-situ locking profile. This locking profile engages the expanded portion of the flow tube, further inhibiting the flow tube and the valve from moving to the closed position.

BRIEF DESCRIPTION OF THE DRAWINGS

So that the manner in which the above-recited features of the present invention are attained and can be understood in detail, a more particular description of the invention, briefly summarized above, may be had by reference to the appended drawings. In some instances, moving parts are shown in solid black for ease of reference. It is to be noted that the appended drawings illustrate only typical embodiments of this invention and are therefore not to be considered limiting of its scope, for the invention may admit to other equally effective embodiments.

Figure 3A:
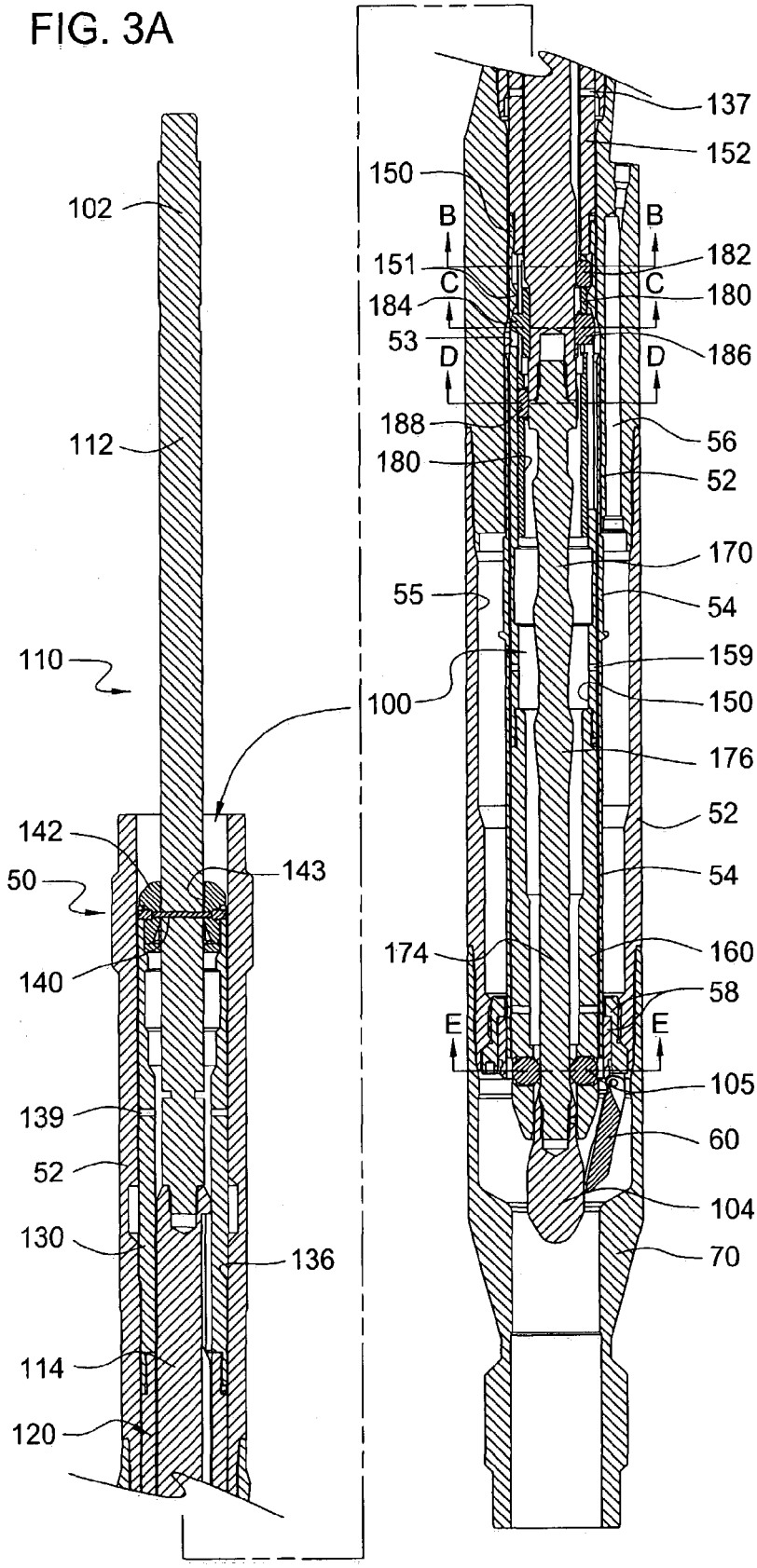
FIG. 3A presents a cross-sectional view of the permanent lockout tool of FIG. 2. In this view, the lockout tool has been landed within a subsurface safety valve. It can be seen that a lower end prong of the tool has contacted the flapper within the valve assembly, forcing the flapper to open.
Figure 3B:
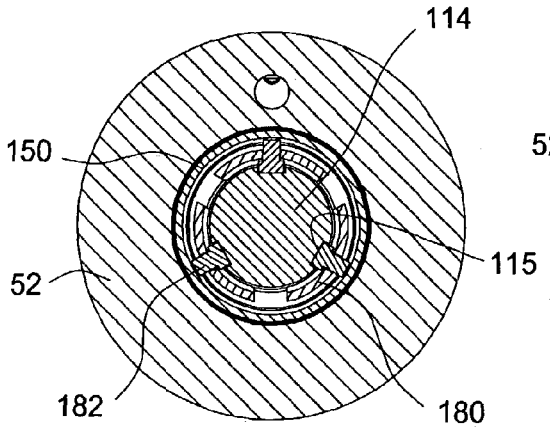
FIG. 3B is a cross-sectional view of the lockout tool of FIG. 3A, taken across line B—B of FIG. 3A. More visible in this view are three carrier sleeve locking dogs pushing outward against an upper housing of the lockout tool. The three carrier sleeve locking dogs are supported by slots machined into the stem extension member.
Figure 3C:
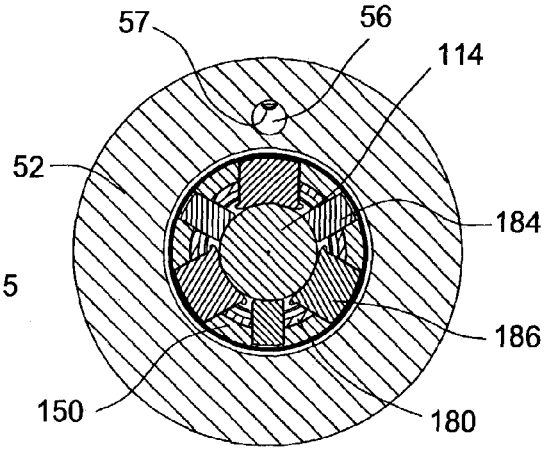
FIG. 3C is a cross-sectional view of the lock out tool of FIG. 3A. Here, the view is taken across line C—C of FIG. 3A. Seen more readily in this view are flow tube dogs and locking dogs radially disbursed around the stem extension, and carried by a carrier sleeve.
Figure 3D:
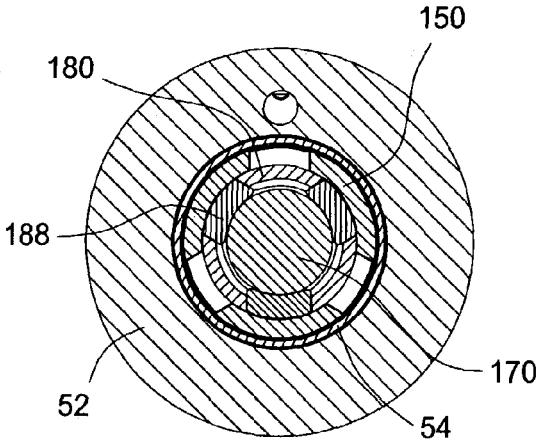
FIG. 3D provides a cross-sectional view of the lockout tool of FIG. 3A, taken across line D—D of FIG. 3A. Visible in this view are carrier sleeve no-go dogs disposed within the housing, and around an expander mandrel. The carrier sleeve no-go dogs are carried by a carrier sleeve.
Figure 3E:
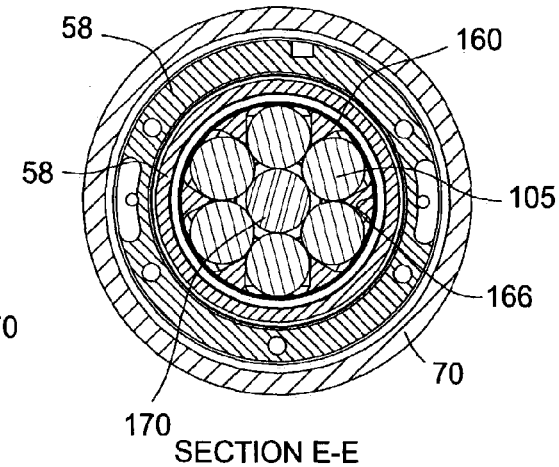

Next, FIG. 3E provides a cross-sectional view through line E—E of FIG. 3A. Visible in this view are a plurality of radially disposed expander balls within a ball housing. The balls are arranged around the expander mandrel. A surrounding string of production tubing is seen.

Figure 4A:
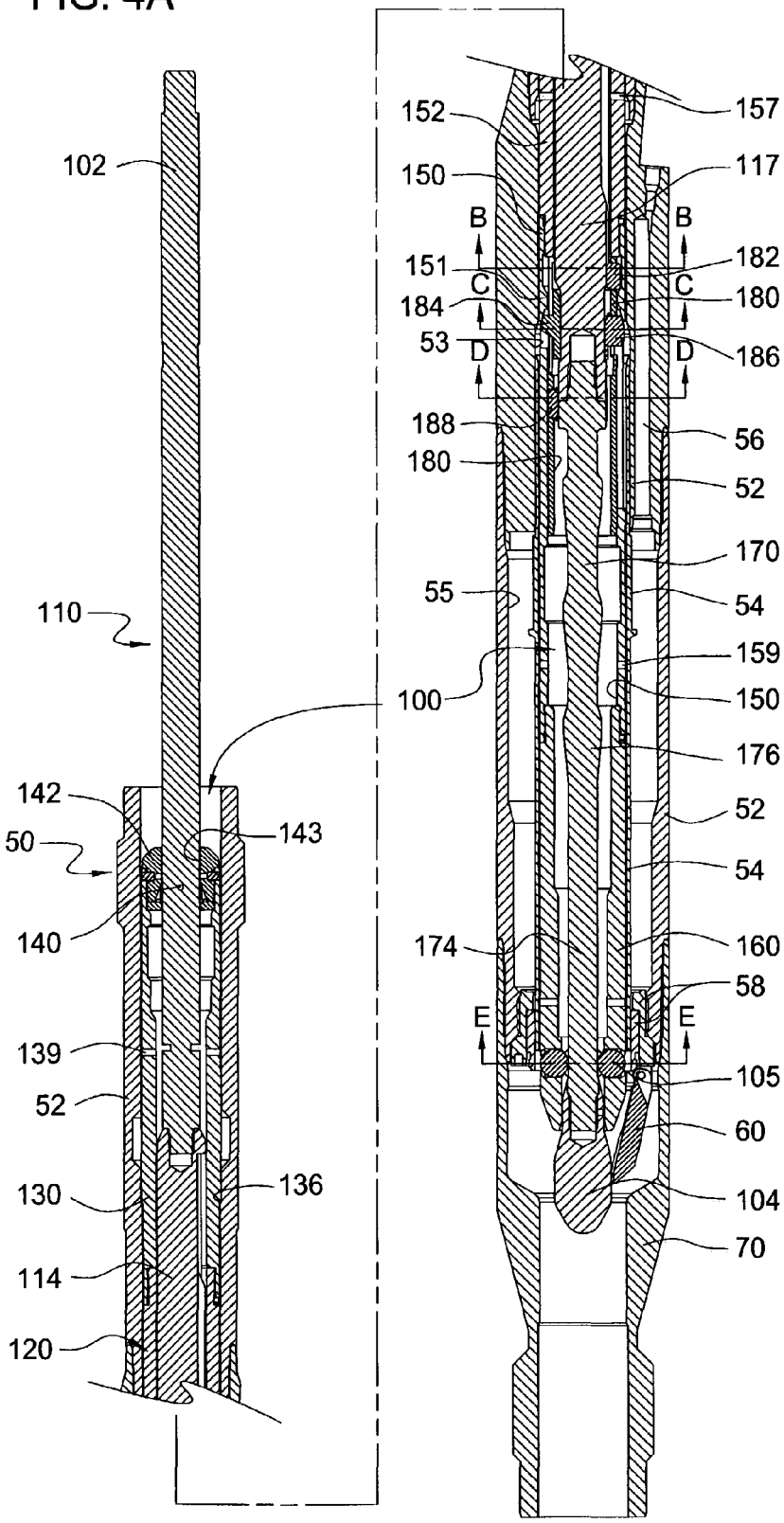

FIG. 4A presents a side elevational view, in cross-section, of the permanent lockout tool of the present invention. In this view, the stem and stem extension members are beginning to be pushed downward into the lockout tool. A shear pin supporting the upper stem has been sheared.

Figure 4B:
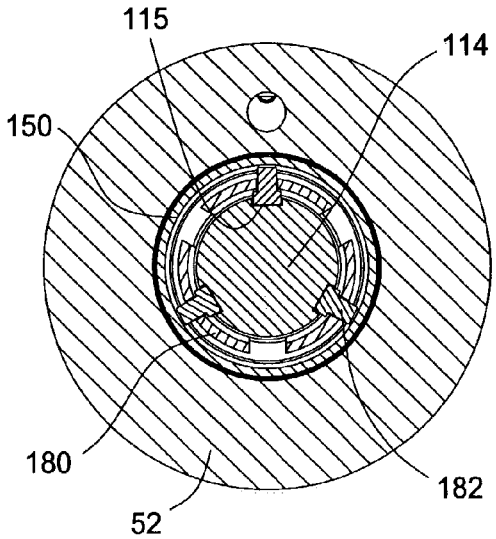

FIG. 4B shows a cross-sectional view of the lockout tool of FIG. 4A, taken across line B—B of FIG. 4A. Visible again in this view are three carrier sleeve locking dogs pushing outward against the upper housing. The three carrier sleeve locking dogs remain supported by the slots machined into the stem extension member.

Figure 4C:
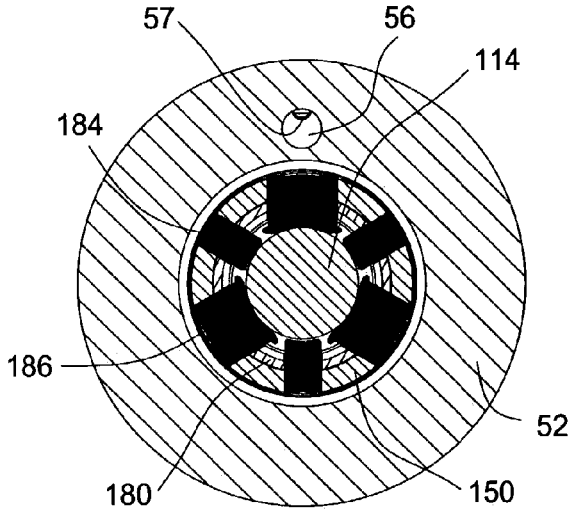

FIG. 4C provides a cross-sectional view of the lockout tool of FIG. 4A. The cut is taken across line C—C. The flow tube dogs and locking dogs are again shown disposed around the stem extension. The locking dogs have not yet backed outwardly, but remain adjacent the stem extension.

Figure 4D:
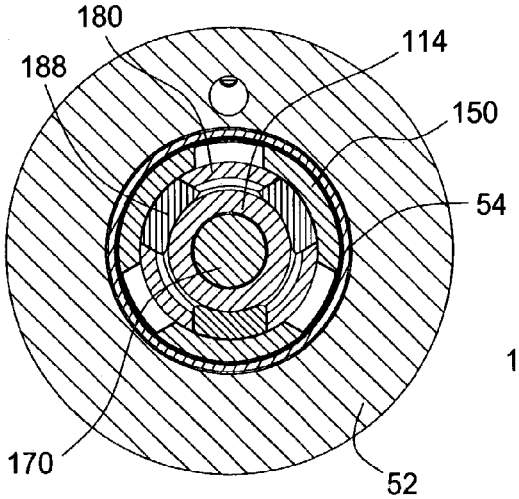

FIG. 4D shows a cross-sectional view of the lockout tool of FIG. 4A, taken across line D—D. In the view, both the stem extension member and the expander mandrel are seen within the carrier sleeve no-go dogs.

Figure 4E:
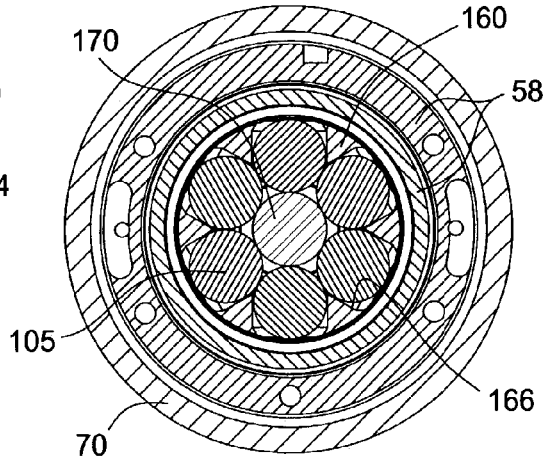

FIG. 4E gives a cross-sectional view of the lockout tool of FIG. 4A, cut through line E—E. There is no change in the relative position of the expander balls as compared to FIG. 3E. In this regard, the expander balls remain fully retracted.

Figure 5A:
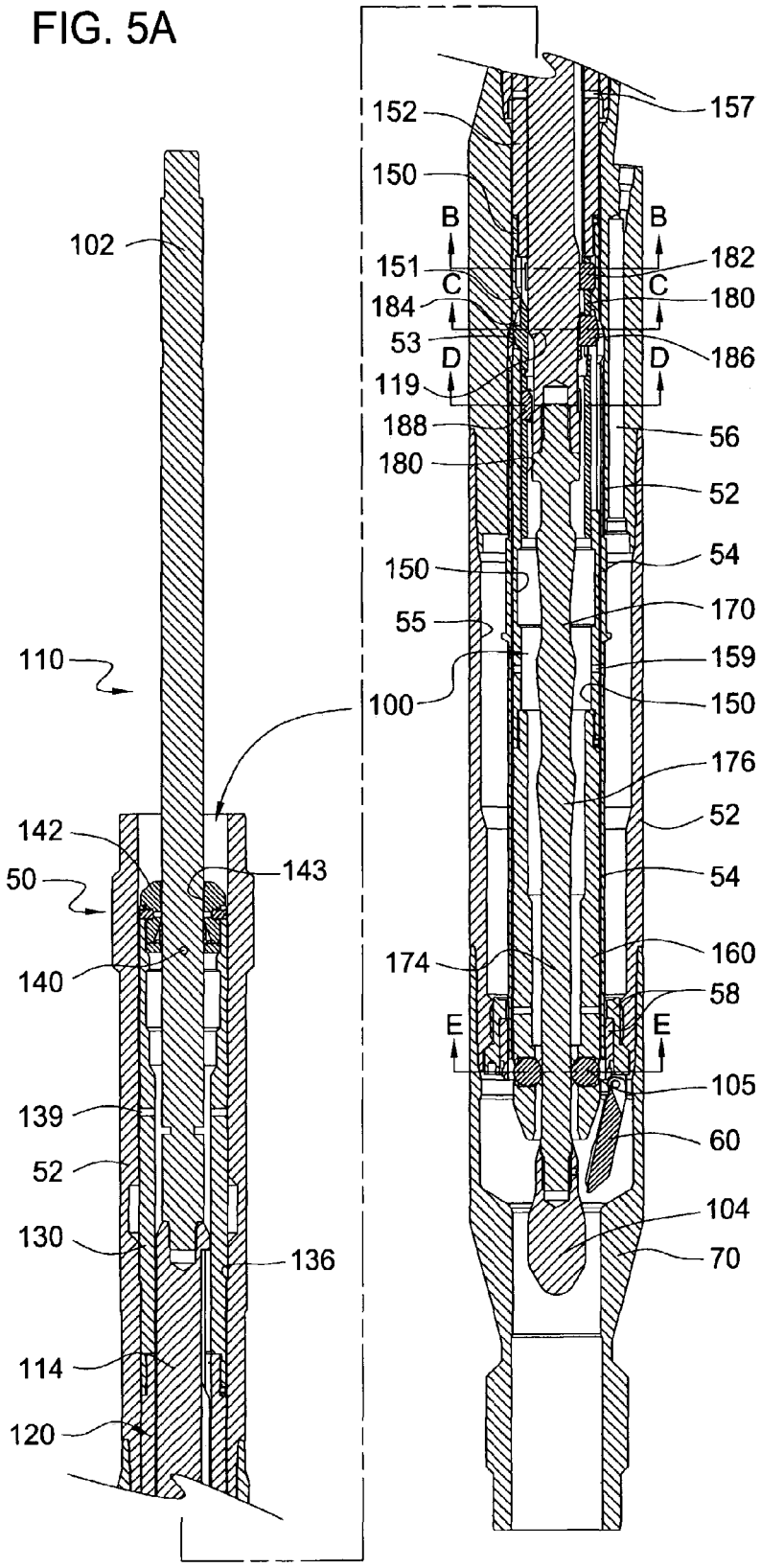

FIG. 5A presents the lockout tool, again in cross-section. In this view, the stem continues to be driven downward into the lock out tool. The locking dogs have now popped outwardly from the stem extension, and have engaged a profile in the safety valve housing.

Figure 5B:
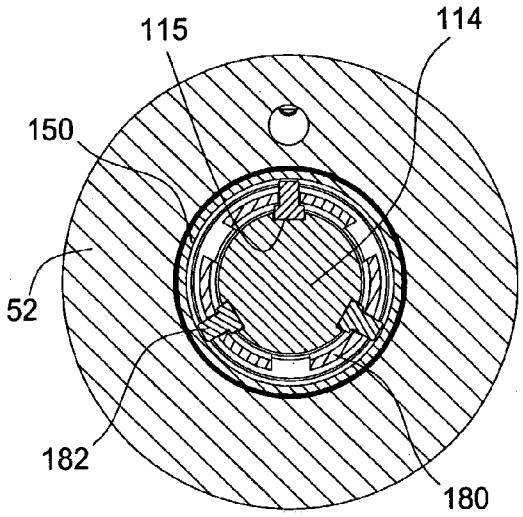

FIG. 5B provides a cross-sectional view of the tool of FIG. 5A, taken across line B—B. There is no relative change in position of the carrier sleeve locking dogs from the view of FIG. 4B.

Figure 5C:
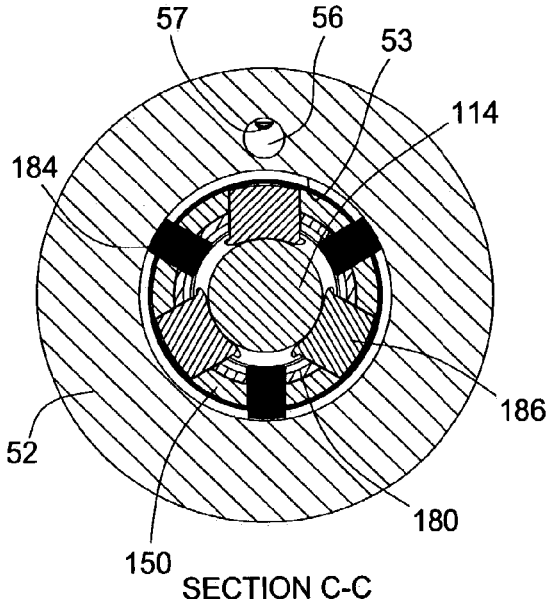

FIG. 5C shows the lockout tool of FIG. 5A, in cross-section. The view is taken across line C—C. In this view, it can be seen that the locking dogs have popped outwardly into the profile of the valve housing.

Figure 5D:
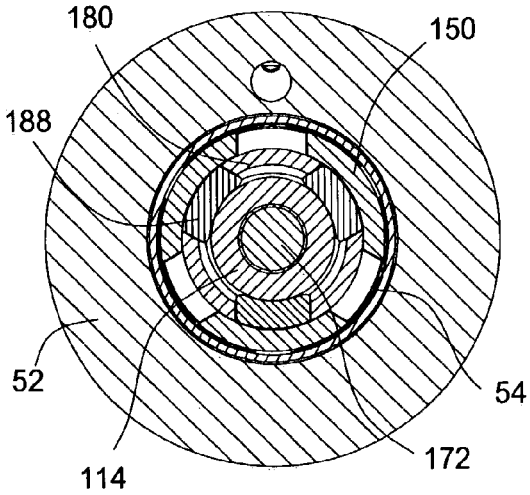

FIG. 5D is a cross-sectional view of the lock out tool of FIG. 5A. Here, the view is taken across line D—D of FIG. 5A. There has been no relative movement of the carrier sleeve no-go dogs in this view as compared to FIG. 4D. Both the stem extension and the expander mandrel are seen within the carrier sleeve no-go dogs.

Figure 5E:
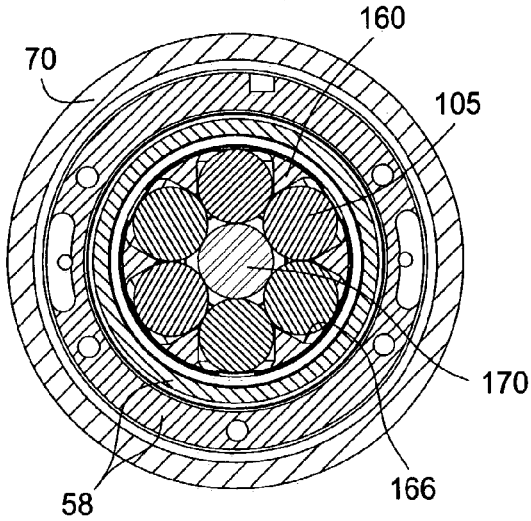

FIG. 5E creates a cross-sectional view of the tool of FIG. 5A, taken across line E—E, and showing again the plurality of expander balls. There is again no change in the relative position of the expander balls as compared to FIG. 3E.

Figure 6A:
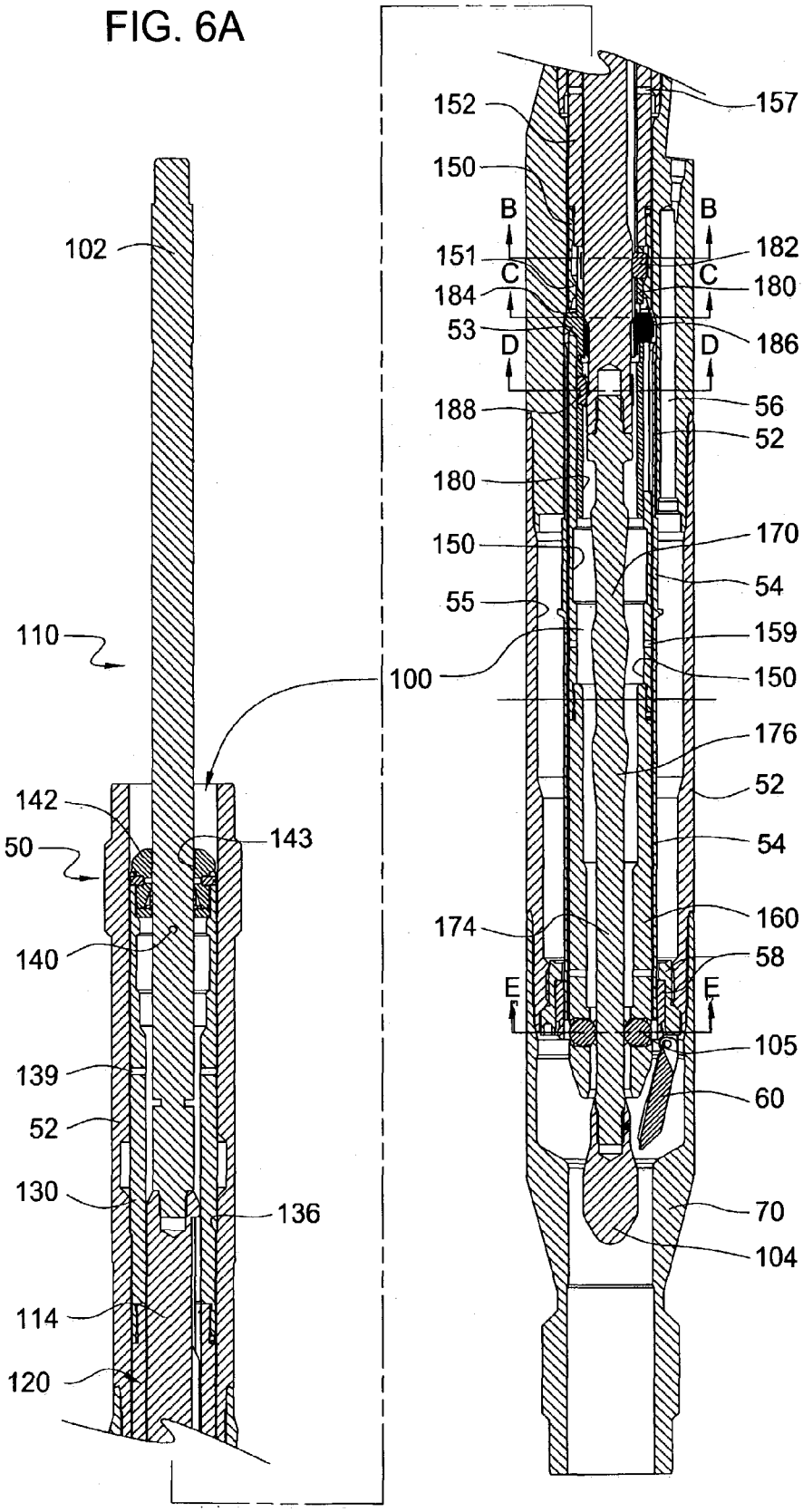

FIG. 6A is a cross-sectional view of the lockout tool of FIG. 5A, and shows the next step in the tool actuation process. The stem continues to be driven downward into the lockout tool. In this view, the flow tube dogs have also popped outwardly into the recess in the valve housing. This enables the flow tube dogs to also clear a shoulder in an upper housing.

Figure 6B:
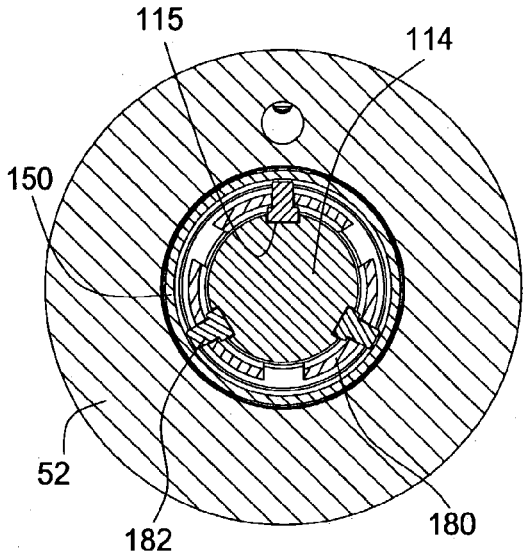

FIG. 6B presents a cross-sectional view of the tool of FIG. 6A. The view is taken across line B—B of FIG. 6A. There is no relative change in position of the carrier sleeve locking dogs from FIG. 5B.

Figure 6C:
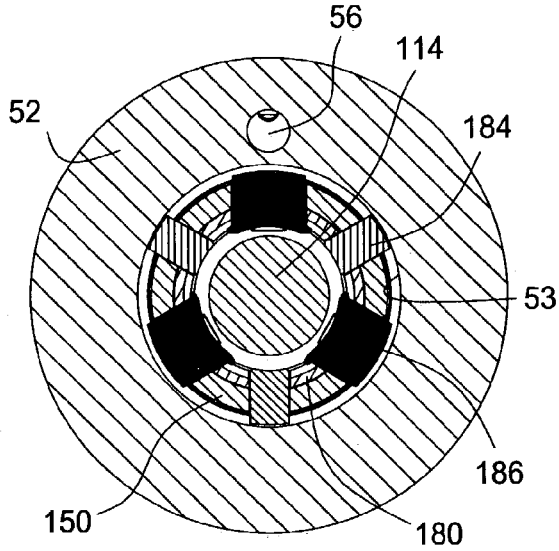

FIG. 6C demonstrates another cross-sectional view of the tool of FIG. 6A, taken across line C—C. In this view, it can be seen that both the flow tube dogs and the locking dogs have expanded outwardly relative to the stem extension.

Figure 6D:
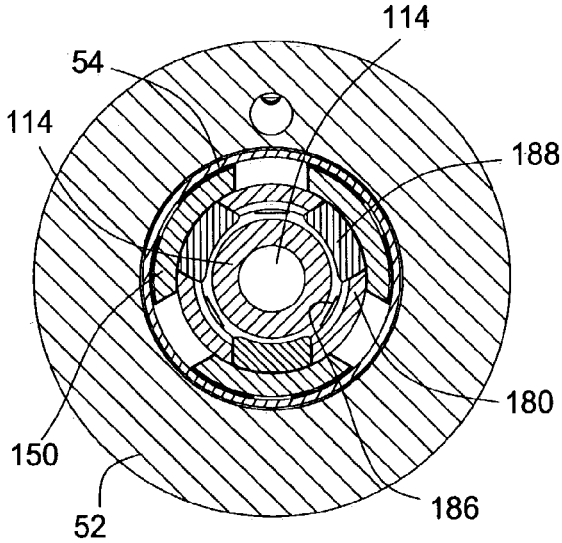

FIG. 6D shows a cross-sectional view of the lockout tool of FIG. 6A. The cut is through line D—D of FIG. 6A. The carrier sleeve no-go dogs are again seen disposed within the flapper valve housing, and around the stem extension member. However, the expander mandrel is no longer seen, as it has been urged below line D—D.

Figure 6E:
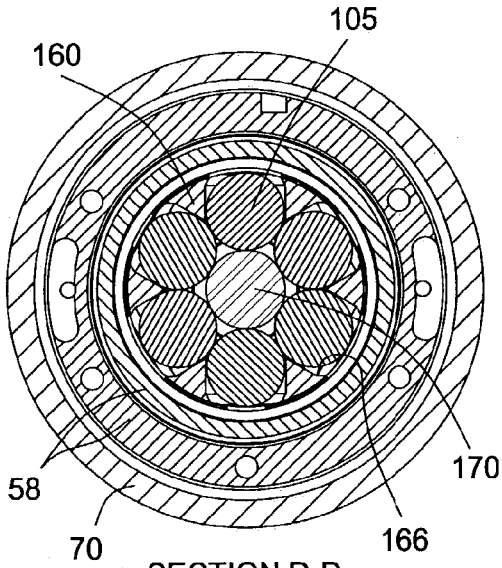

FIG. 6E creates a cross-sectional view of the tool of FIG. 6A, taken across line E—E. There is still no change in the relative position of the expander balls as compared to FIG. 3E, meaning that the expander balls remain retracted.

Figure 7A:
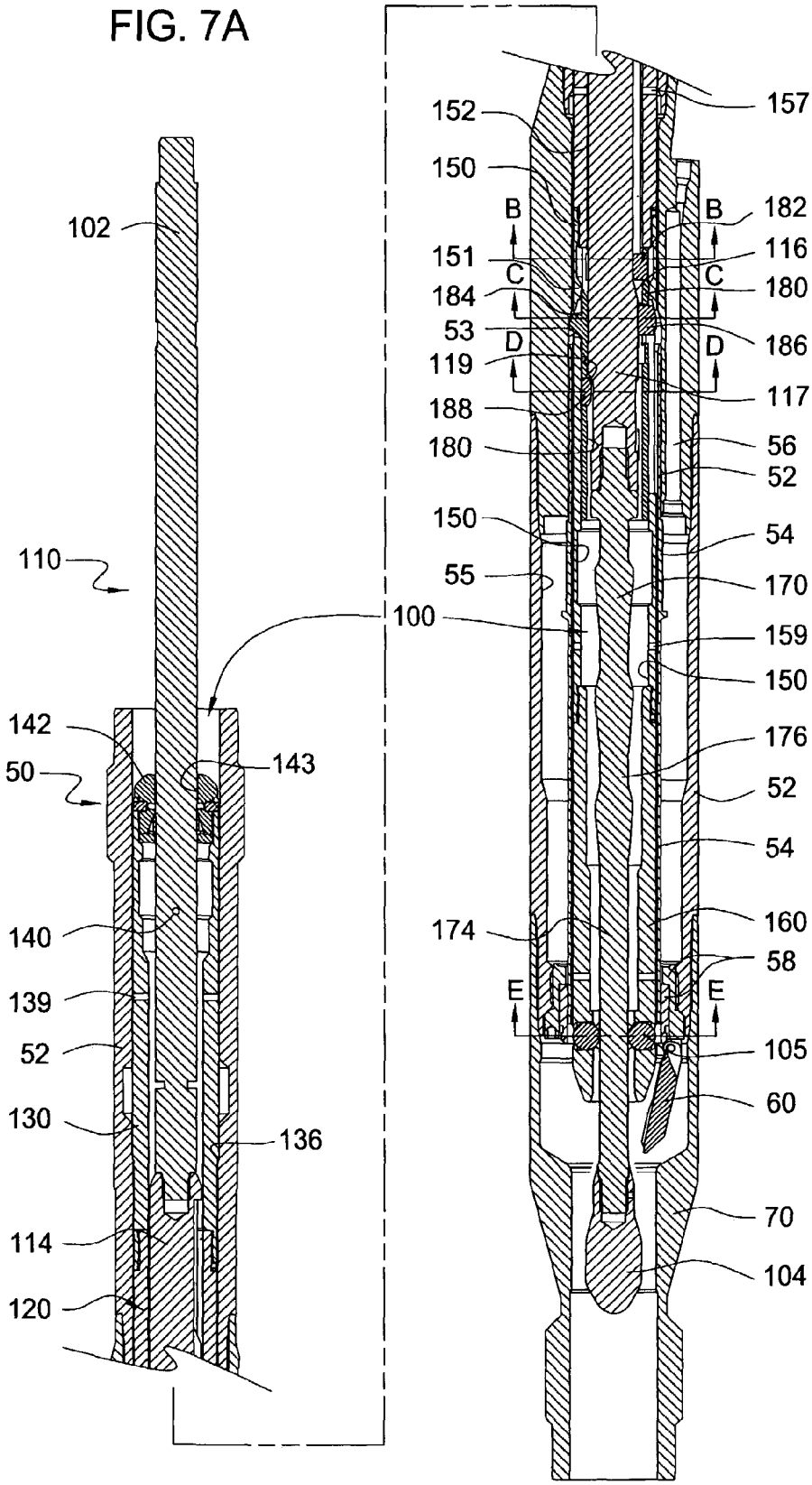

FIG. 7A is a side elevational view, in cross-section, of the permanent lockout tool of the present invention, presenting the next step in the tool actuation process. In this view, the stem continues to be driven still further into the lockout tool. This has enabled the carrier sleeve locking dogs to clear an enlarged outer diameter portion of the stem extension member. A lower shoulder in the stem extension member has now engaged the no-go dogs.

Figure 7B:
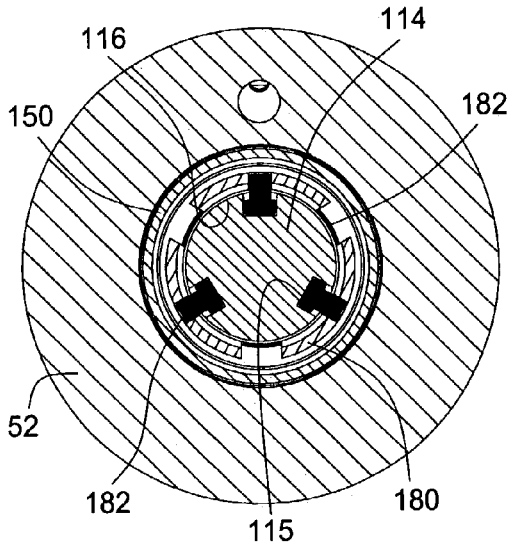

FIG. 7B provides a cross-sectional view of the tool of FIG. 7A, taken across line B—B of FIG. 7A. It can be seen that the carrier sleeve locking dogs have been able to move inwardly due to the reduced outer diameters of the slots in the stem extension.

Figure 7C:
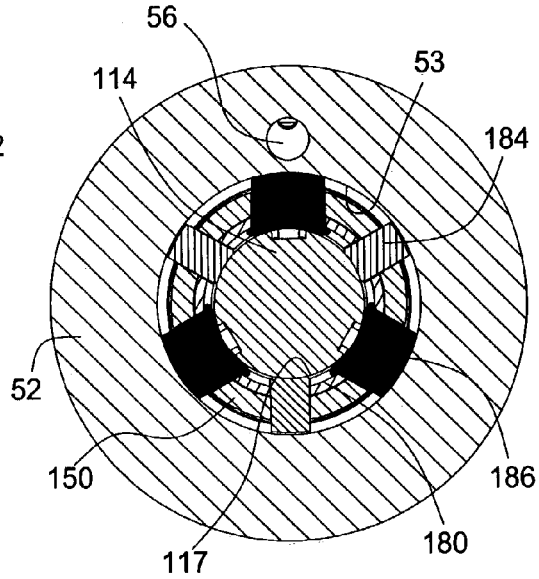

FIG. 7C shows a cross-sectional view of the tool of FIG. 7A. Here, the view is taken across line C—C. Visible again in this view are flow tube dogs and locking dogs radially disposed around the stem extension member. It can be seen that the outer diameter of the stem extension is enlarged relative to the cross-sectional view of FIG. 6C.

Figure 7D:
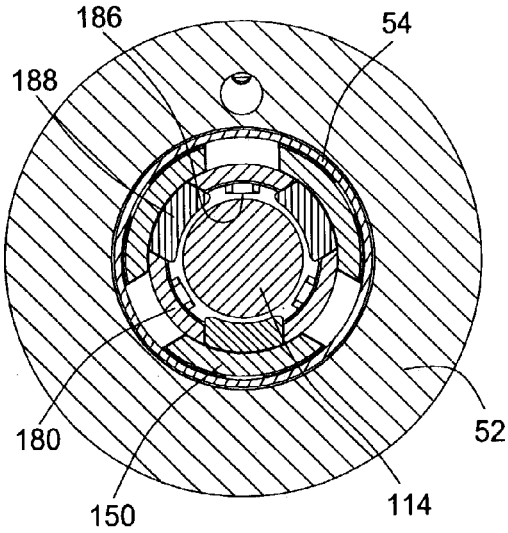

FIG. 7D creates a cross-sectional view of the lockout tool of FIG. 7A, with the view cut across line D—D. A lower shoulder below the enlarged outer diameter portion of the stem extension member has engaged the carrier sleeve no-go dogs. This allows the stem extension member to push downwardly on the carrier sleeve no-go dogs and attached carrier sleeve.

Figure 7E:
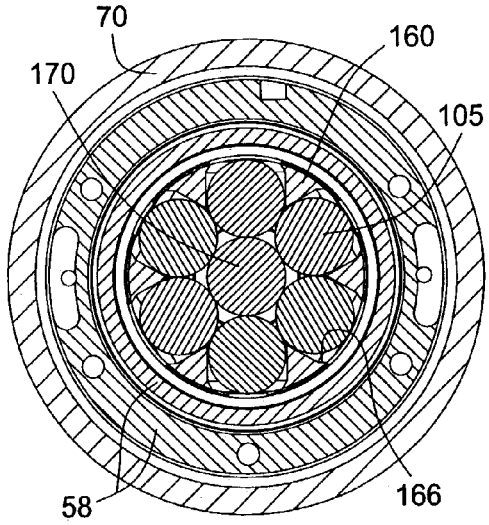

Next, FIG. 7E provides a cross-sectional view through line E—E. There is yet no change in the relative position of the expander balls as compared to FIG. 3E.

Figure 8A:
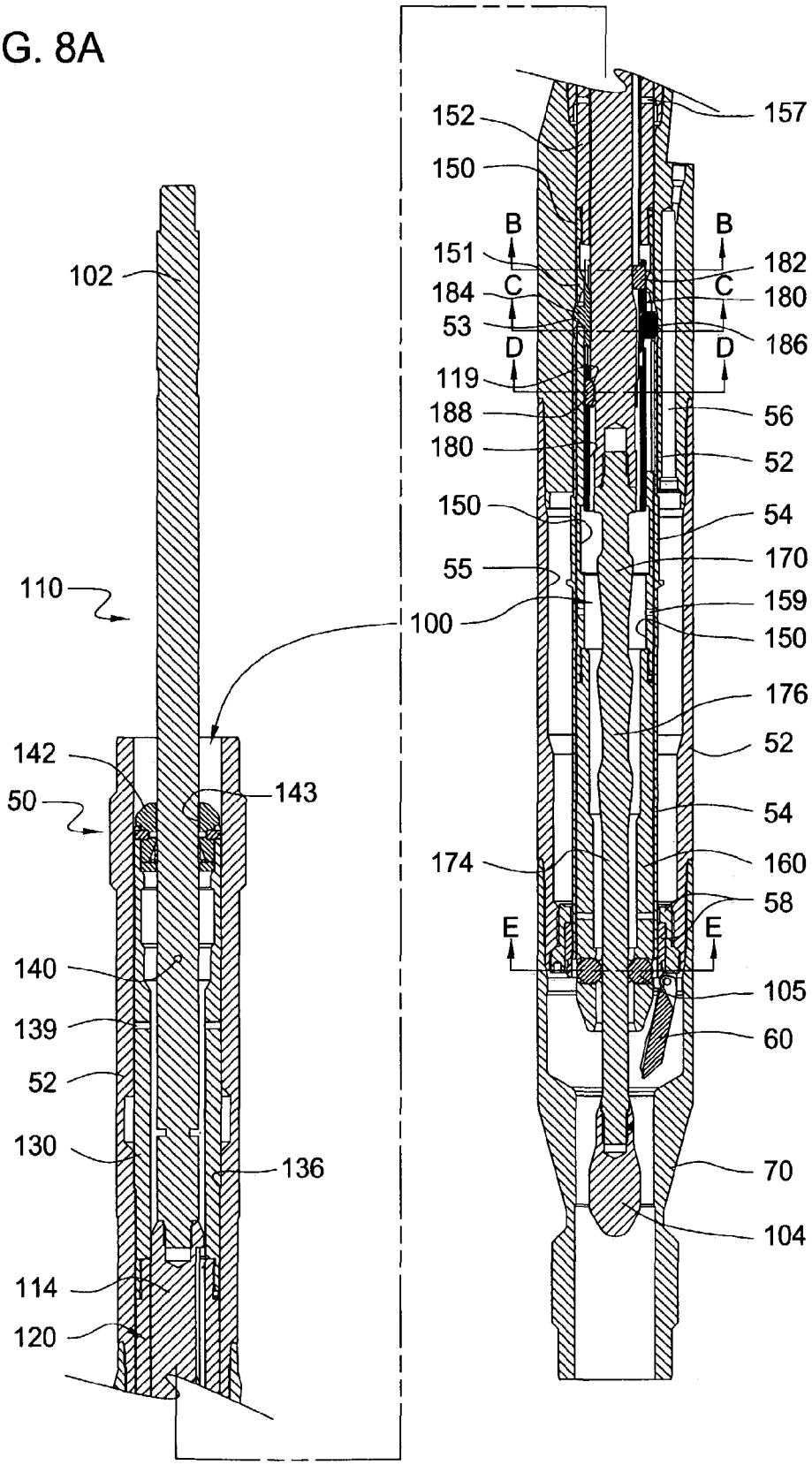

FIG. 8A presents yet another cross-sectional view of the tool of the present invention, in one embodiment. The next step in the tool actuation step is presented. In this view, the stem continues to be driven downward into the lockout tool. The flow tube dogs have extended further outwardly in order to shoulder against the top of the flow tube in the safety valve. As the stem is driven downward, it will drive the flow tube downwardly.

Figure 8B:
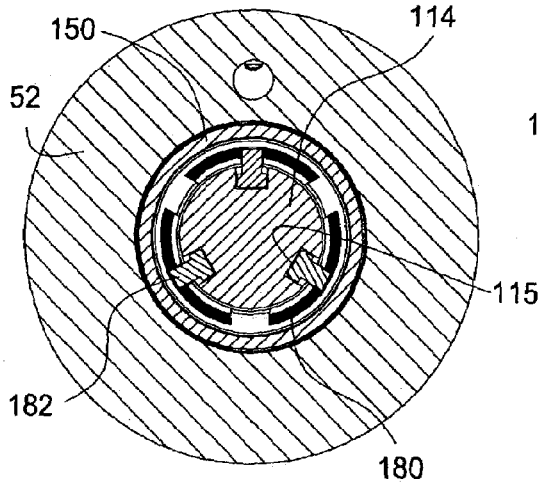

FIG. 8B provides a cross-sectional view of the tool of FIG. 8A, with the view taken across line B—B. Three carrier sleeve locking dogs are again visible adjacent the carrier sleeve. The diameters of the slots in the stem extension is now reduced.

Figure 8C:
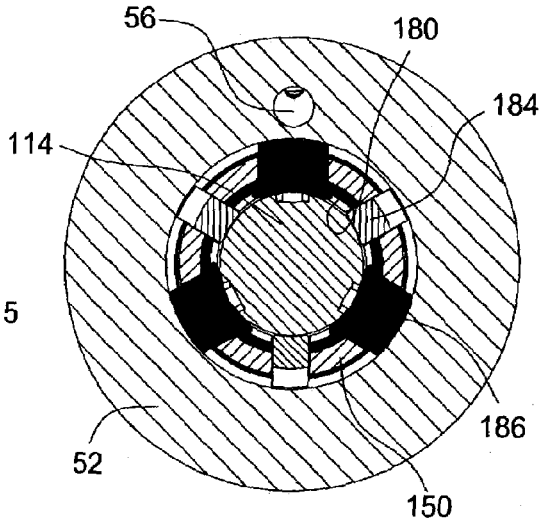

FIG. 8C shows a cross-sectional view of the lock out tool of FIG. 8A, cut across line C—C. The flow tube dogs and locking dogs are seen radially disbursed about the carrier sleeve. The flow tube dogs are fully expanded outwardly against the inner diameter of the safety valve housing, and are in position to exert downward force against the flow tube.

Figure 8D:
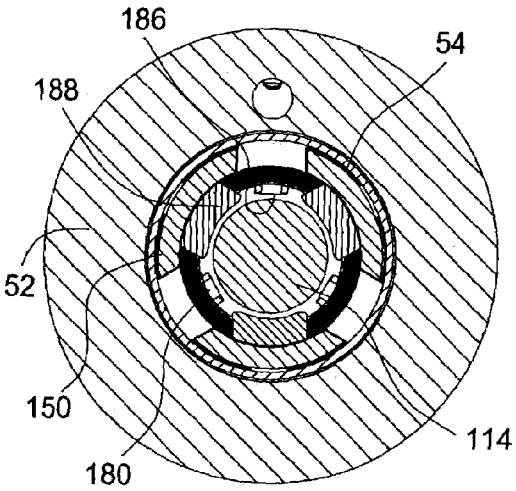

FIG. 8D gives a cross-sectional view of the lock out tool of FIG. 8A, shown through line D—D of FIG. 8A. The carrier sleeve no-go dogs are seen riding with the carrier sleeve.

Figure 8E:
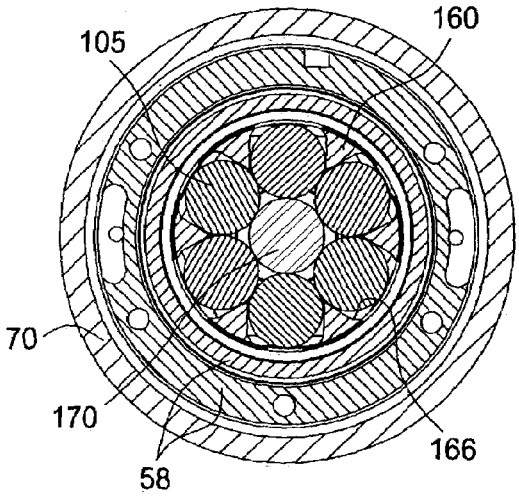

FIG. 8E shows a cross-sectional view of the tool of FIG. 8A, taken across line E—E. There remains no visible change in the relative position of the expander balls as compared to FIG. 3E.

Figure 9A:
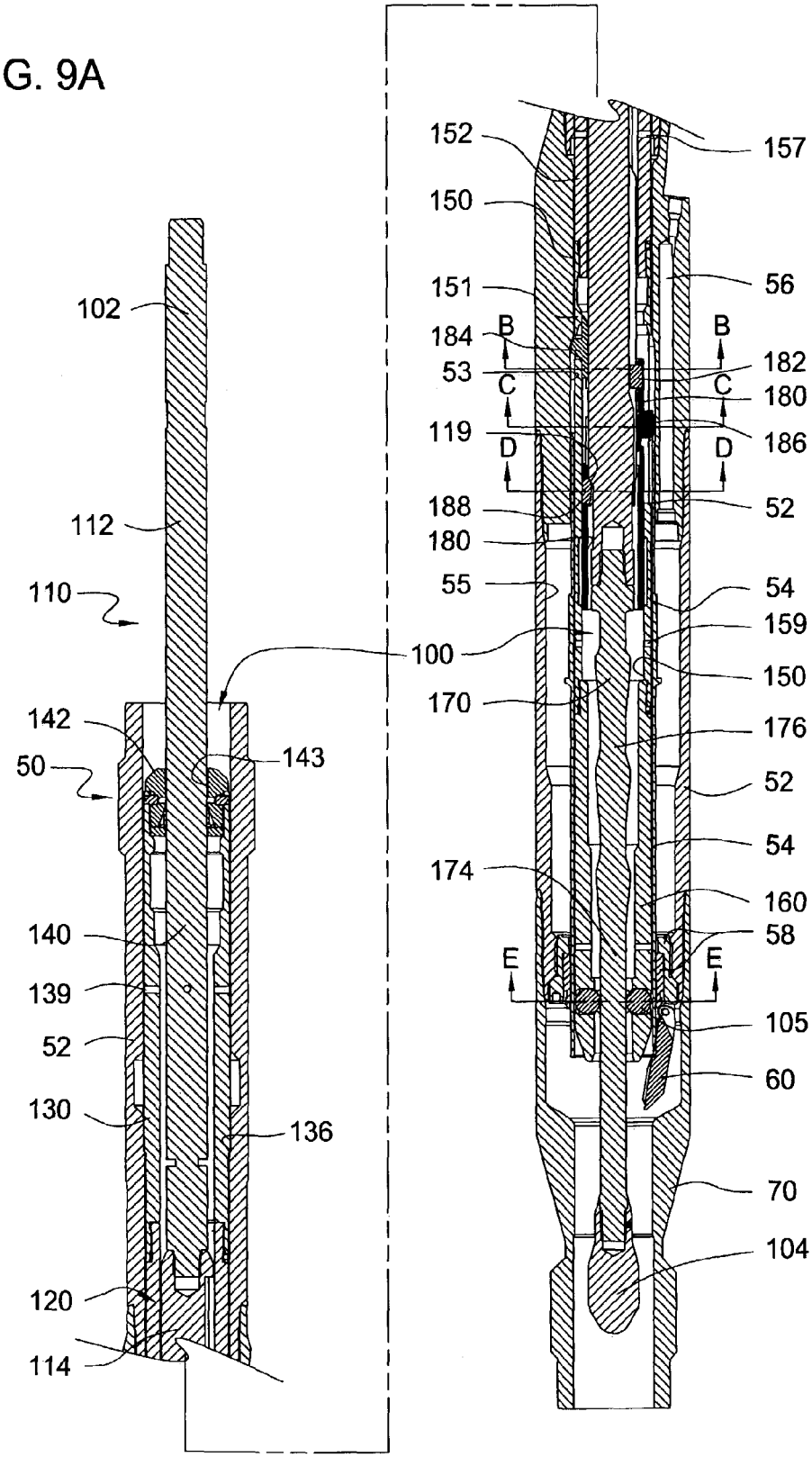

FIG. 9A presents a cross-sectional view of the permanent lockout tool of FIG. 8A. In this view, the stem continues to be driven downward into the housing of the tool. The carrier sleeve and connected flow tube dogs are seen driving the flow tube downward. Also, the stem extension member is driving the carrier sleeve no-go dogs and connected carrier sleeve downward.

Figure 9B:
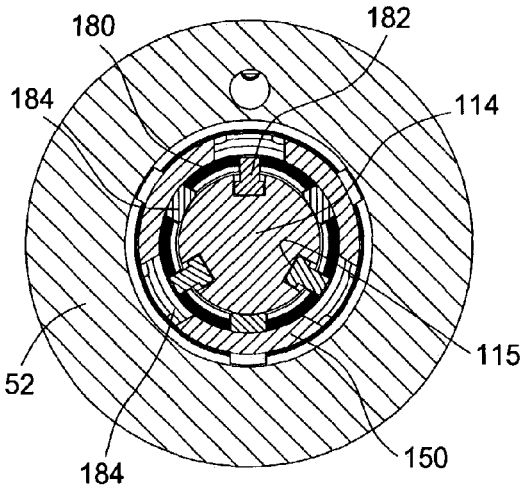

FIG. 9B provides a cross-sectional view of the tool of FIG. 9A. The view is taken across line B—B of FIG. 9A. The locking dogs are now seen adjacent the carrier sleeve locking dogs around the carrier sleeve.

Figure 9C:
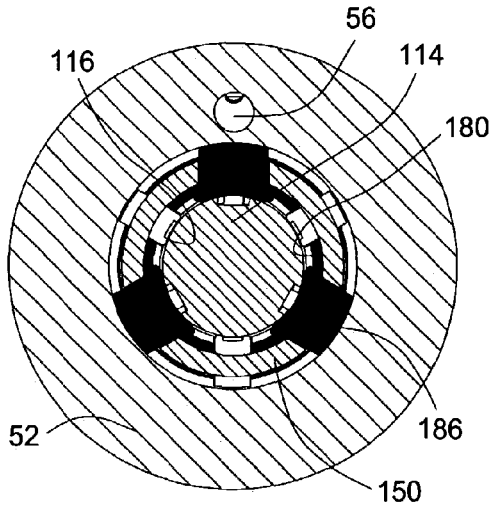

FIG. 9C is a cross-sectional view of the lock out tool of FIG. 9A, taken across line C—C of FIG. 9A. The flow tube dogs are fully expanded outwardly against the inner diameter of the safety valve housing, and are in position to exert downward force against the flow tube.

Figure 9D:
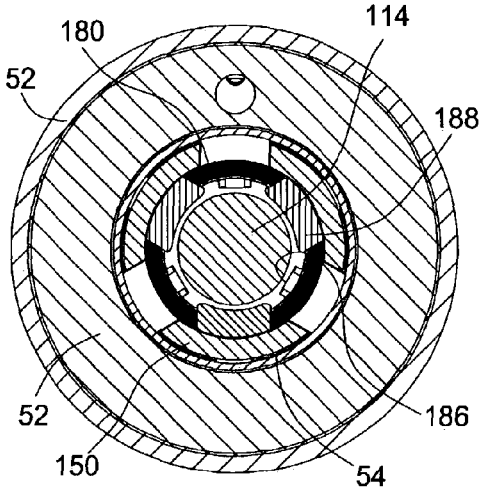

FIG. 9D is a cross-sectional view of the lock out tool of FIG. 9A, taken across line D—D of FIG. 9A. Visible in this view are carrier sleeve no-go dogs disposed within the flapper valve housing, and around the expander mandrel. The carrier sleeve no-go dogs continue to be driven downward by the stem extension member.

Figure 9E:
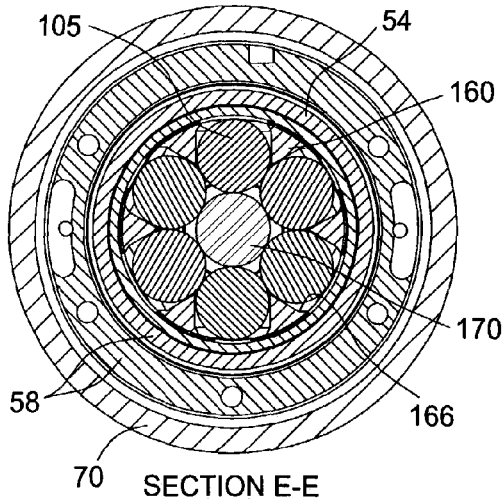

FIG. 9E creates a cross-sectional view of the lockout tool of FIG. 9A, taken across line E—E. There remains no change in the relative position of the expander balls as compared to FIG. 3E such that the expander balls remain retracted. However, the flow tube is now visible adjacent the balls.

Figure 10A:
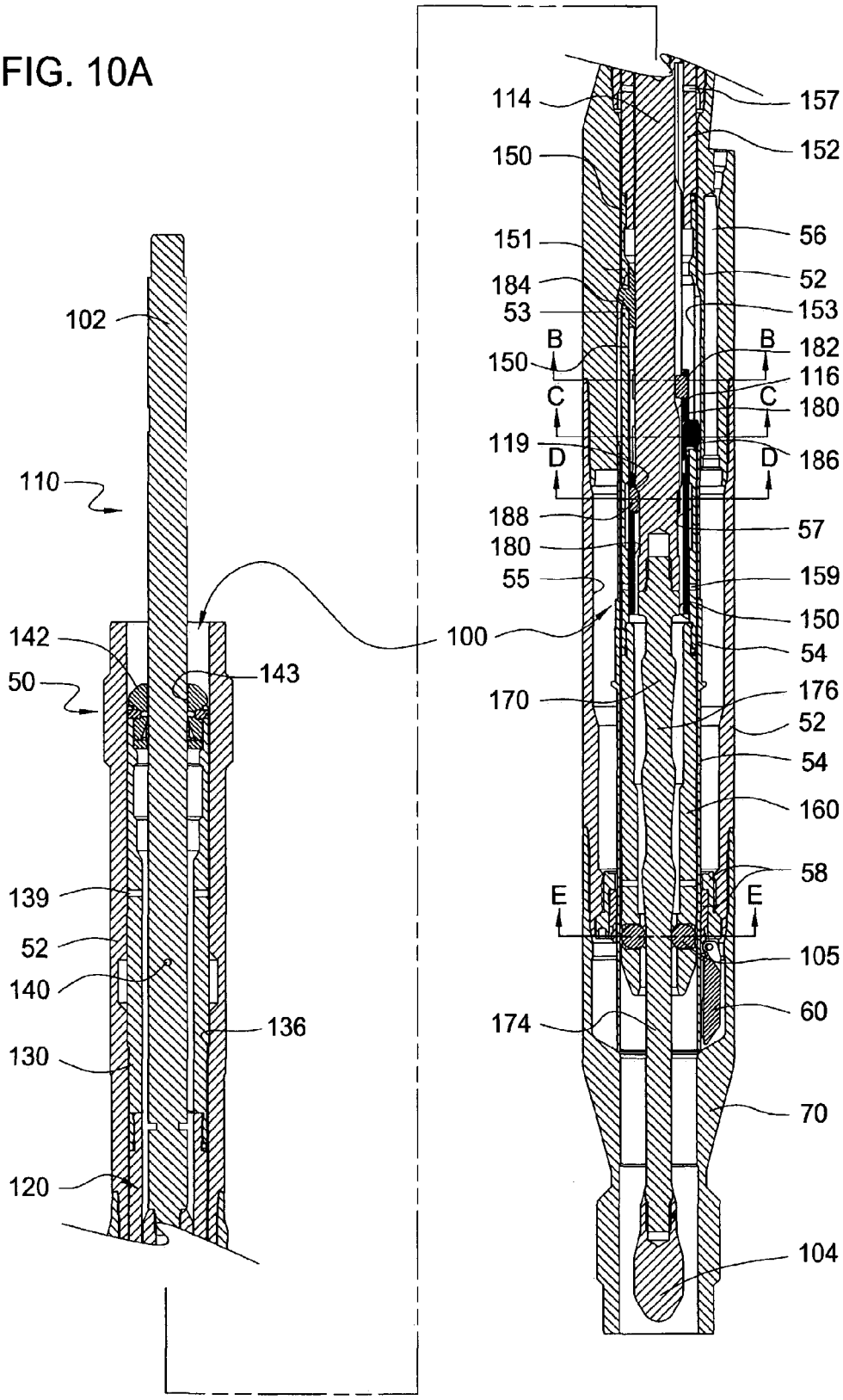

FIG. 10A presents the next step in the actuation process for the lockout tool after the step of FIG. 9A. FIG. 10A is another cross-sectional view of the lockout tool. In this view, the stem and connected stem extension member have been driven further downward into the housing for the safety valve. The flow tube dogs have now moved the flow tube to the end of its downward stroke. The flapper valve is fully opened by the flow tube.

Figure 10B:
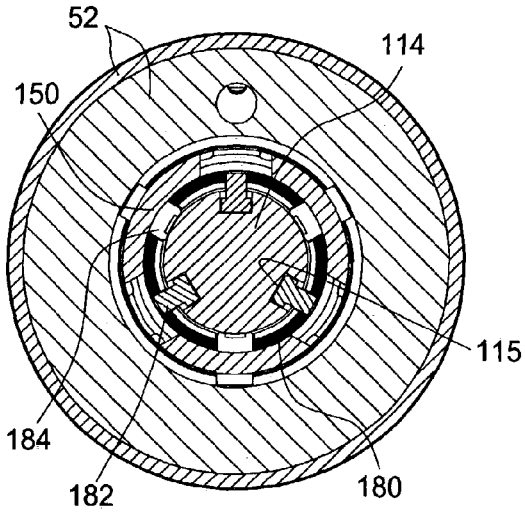

FIG. 10B provides a cross-sectional view of the lockout tool of FIG. 10A, taken across line B—B. The carrier sleeve locking dogs continue to move downward through the safety valve housing with the stem and the carrier sleeve.

Figure 10C:
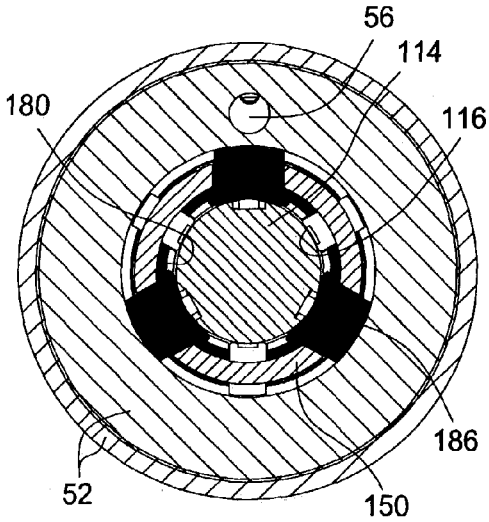

FIG. 10C shows a cross-sectional view of the tool, with the view being taken through line C—C. The flow tube dogs are again visible, and remain fully expanded outwardly against the inner diameter of the safety valve housing.

Figure 10D:
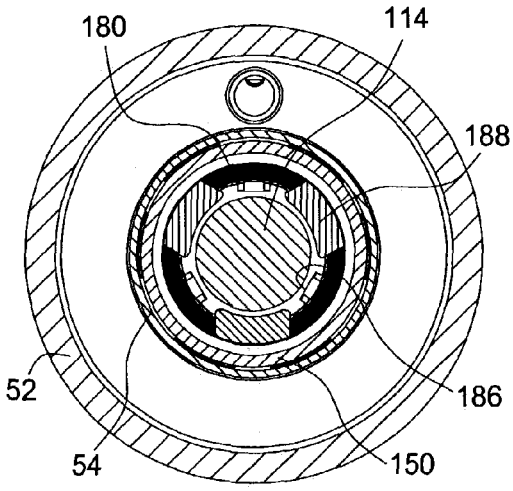

FIG. 10D demonstrates a cross-sectional view of the lockout tool, cut through line D—D of FIG. 10A. The carrier sleeve no-go dogs continue to be driven downward by the lower shoulder in the stem extension member.

Figure 10E:
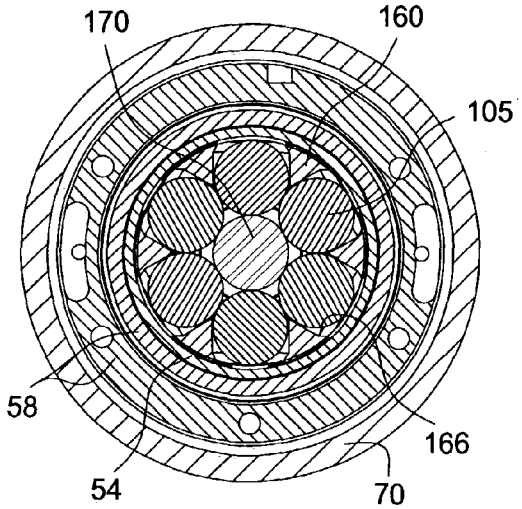

FIG. 10E shows the lockout tool of FIG. 10A, in cross-section. The view is taken across line E—E. There is again no change in the position of the expander balls relative to the flow tube of the safety valve as compared to FIG. 3E. The flow tube remains visible circumferentially around the ball housing keeping the flapper in its fully open position.

Figure 11A:
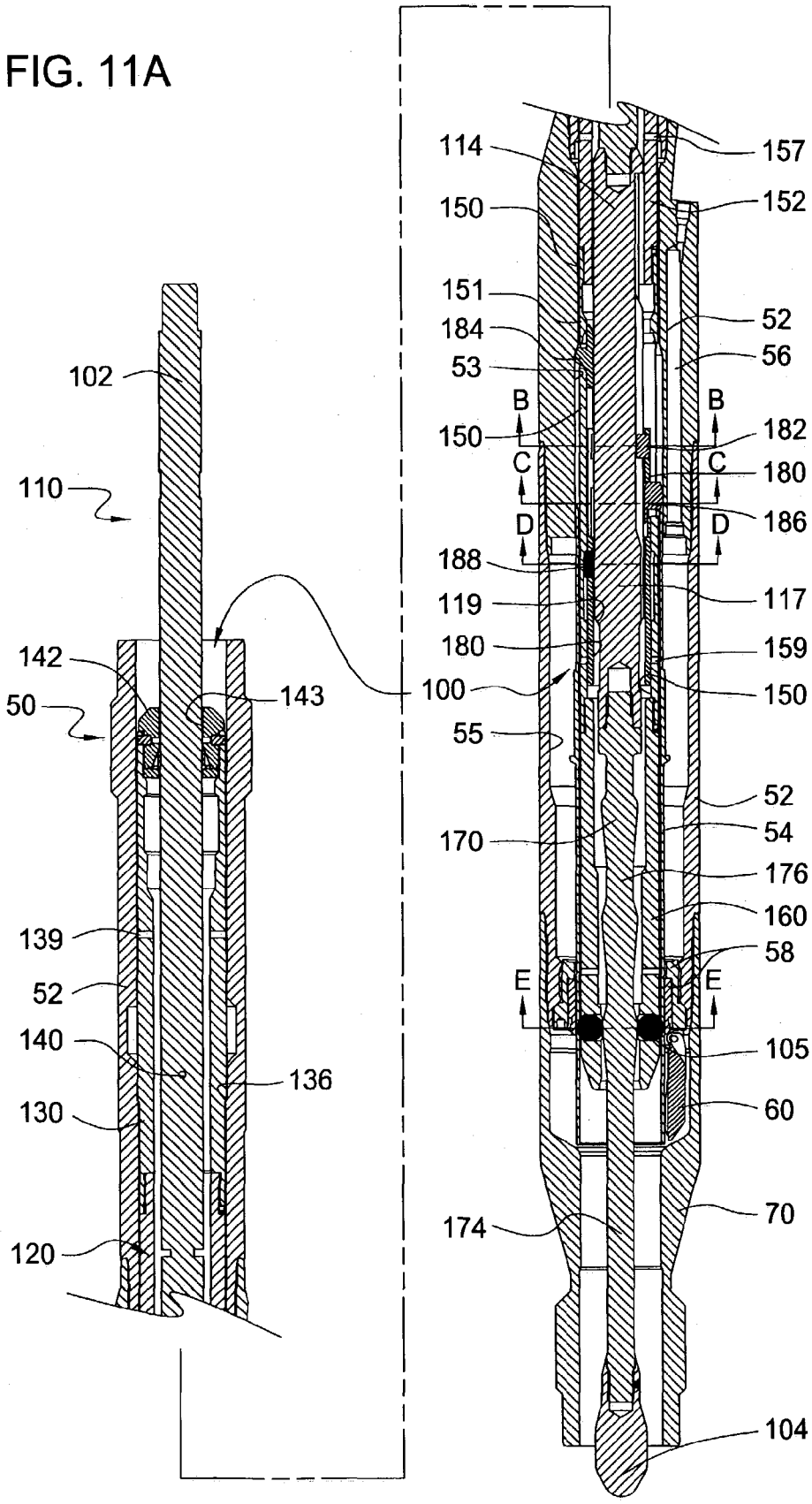

FIG. 11A is a cross-sectional view of the lockout tool, in its next step of tool actuation. In this view, the stem is moving still further downward into the safety valve. The connected stem extension member is now moving downwardly inside the flow tube. In addition, the carrier sleeve no-go dogs have popped outwardly into a recess in the upper housing, allowing the stem extension to also move downwardly relative to the carrier sleeve and connected no-go dogs. Most importantly, an enlarged diameter portion of the expander mandrel is now contacting the expander balls.

Figure 11B:
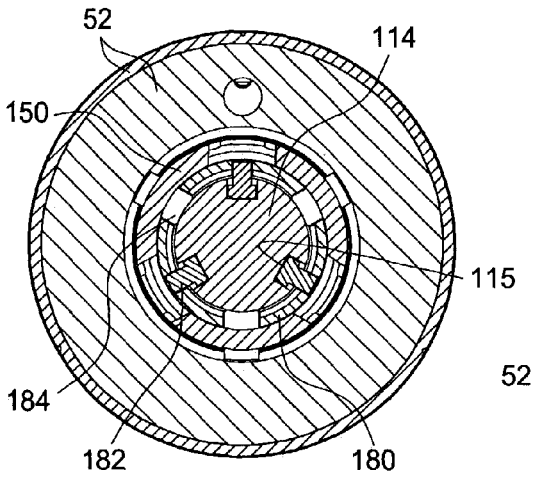

FIG. 11B provides a cross-sectional view of the lockout tool of FIG. 11A, taken across line B—B. The position of the carrier sleeve locking dogs relative to the upper housing has not changed from the view of FIG. 10B.

Figure 11C:
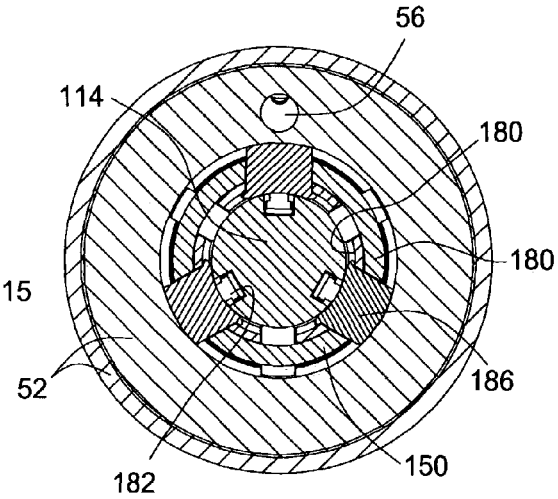

FIG. 11C shows the lockout tool of FIG. 11A, in cross-section. The view is taken across line C—C. There is also no change in the position of the flow tube dogs relative to the tool housing.

Figure 11D:
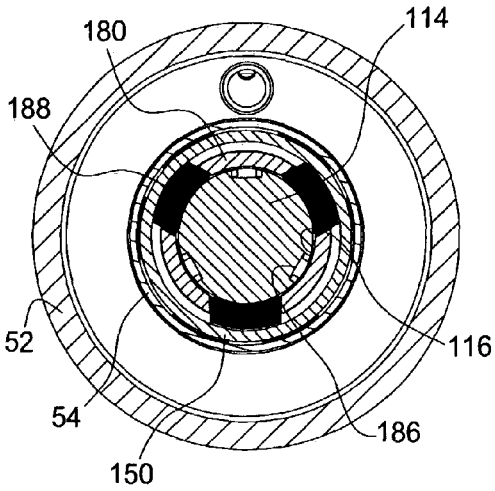

FIG. 11D gives another cross-sectional view of the tool of FIG. 11A. Here, the view is taken across line D—D. The carrier sleeve no-go dogs, which have been urged outwardly into a recess in the housing, are adjacent the enlarged diameter portion of the stem extension member.

Figure 11E:
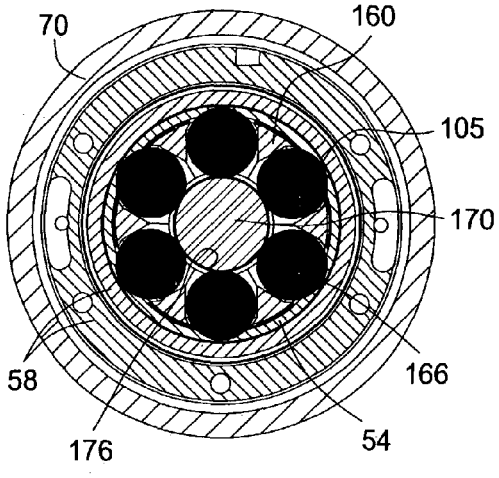

Next, FIG. 11E provides a cross-sectional view through line E—E. The plurality of expander balls is again seen. It can be seen that the diameter of the expander mandrel has been enlarged relative to the diameter shown in previous "E—E" cross-section views. This causes the expander balls to be urged outwardly against the flow tube.

Figure 12A:
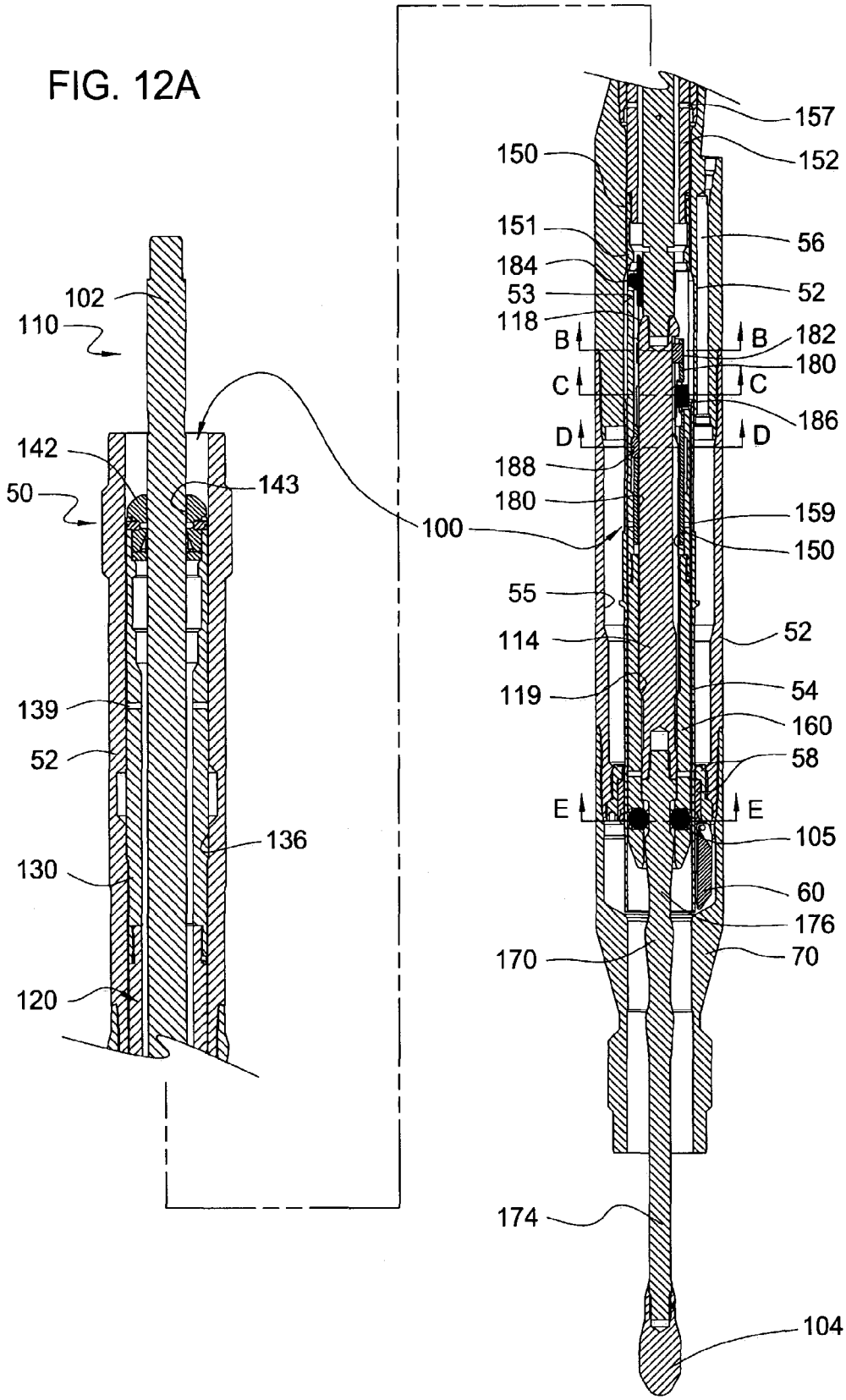

FIG. 12A presents a cross-sectional view of the lockout tool of FIG. 11A. FIG. 12A provides the final step in the lockout process. In this view, it can be seen that the expander mandrel has been driven through the flapper of the safety valve. The expander balls and flow tube dogs have retracted, allowing the tool to be later removed from the wellbore with tension placed in the slickline (or other working string).

Figure 12B:
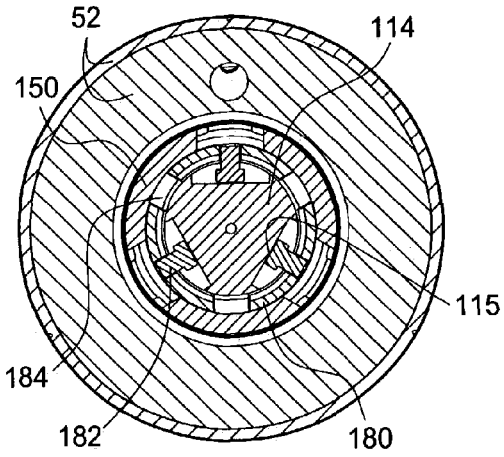

FIG. 12B is a cross-sectional view of the tool of FIG. 12A, taken across line B—B. The stem extension member has been moved through the tool housing to the extent that the upper end of the stem extension member is adjacent the locking dogs.

Figure 12C:
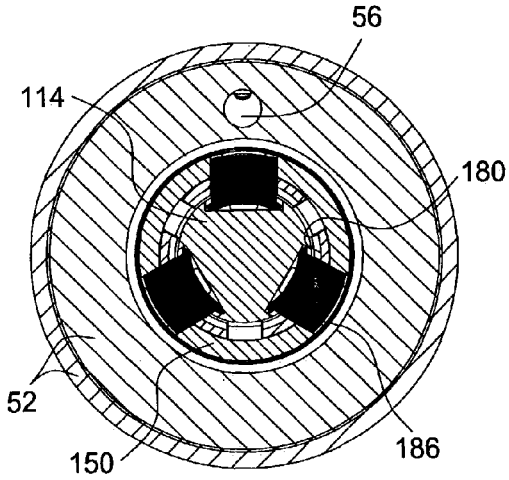

FIG. 12C provides a cross-sectional view taken across line C—C of FIG. 12A. It can be seen that the flow tube dogs have cleared the enlarged diameter portion of the stem extension. The flow tube dogs are recessing inward to a reduced diameter cut in the stem extension.

Figure 12D:
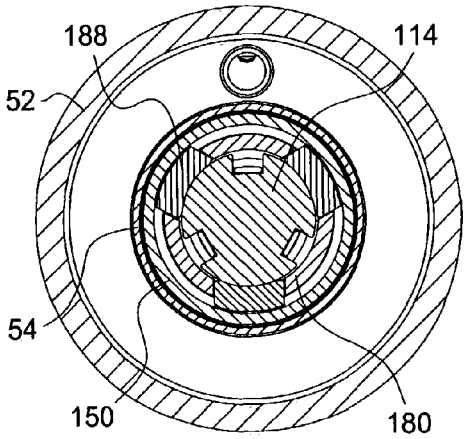

FIG. 12D shows the tool of FIG. 12A in cross-section, with the view being taken across line D—D. The carrier sleeve no-go dogs slideably receive the stem extension member.

Figure 12E:
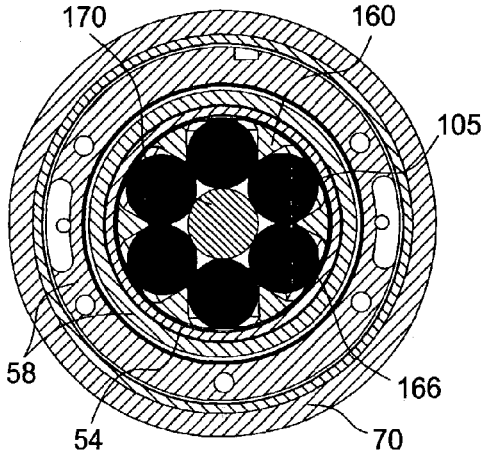

FIG. 12E shows the lockout tool, in cross-section. The view is taken across line E—E of FIG. 12A. The expander balls have retracted and are no longer acting against the radial dimension of the flow tube.

Figure 13:
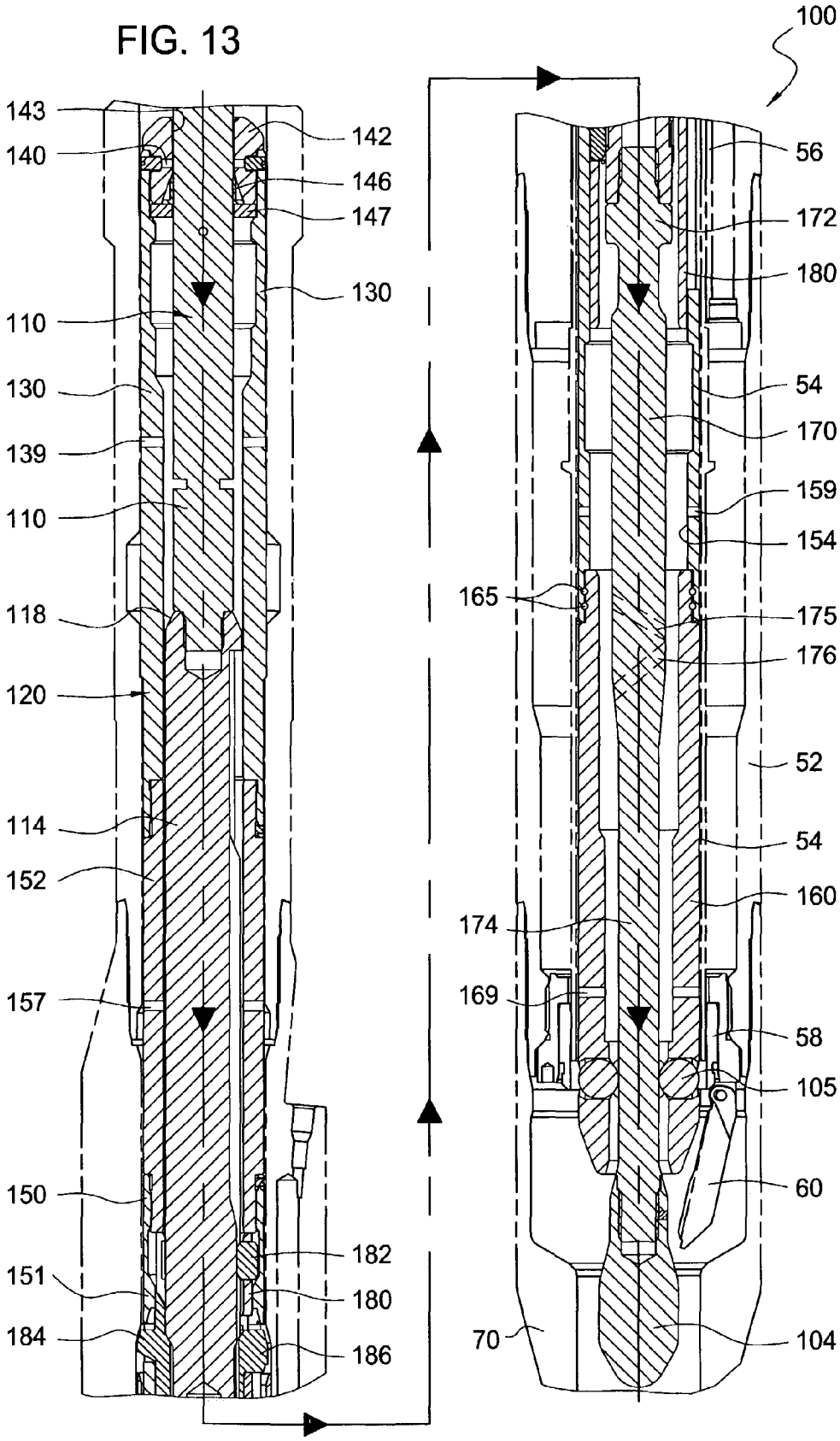

FIG. 13 presents a cross-sectional view of an alternate embodiment of the lockout tool of the present invention. In this arrangement, a grooved and spiraled spline is placed around the expander mandrel at the level of the enlarged diameter portion.

Figure 14:
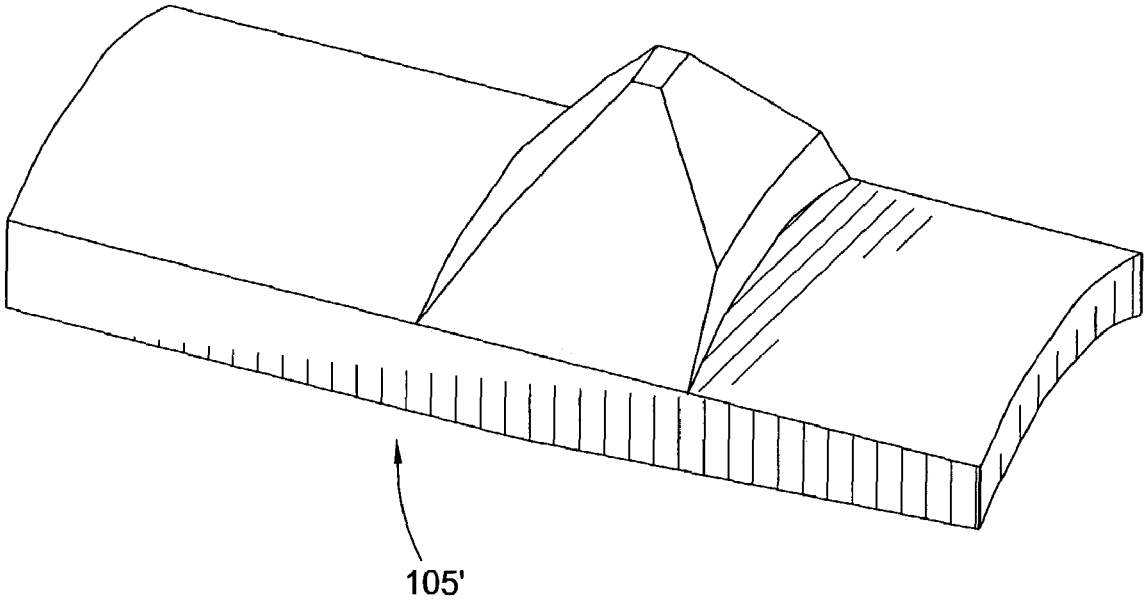

FIG. 14 presents a perspective view of an expander point that might be used in lieu of an expander ball. The expander point of this figure is a dog. A plurality of radially disbursed dogs would be deployed around the ball housing where the dogs are used.

Figure 1:
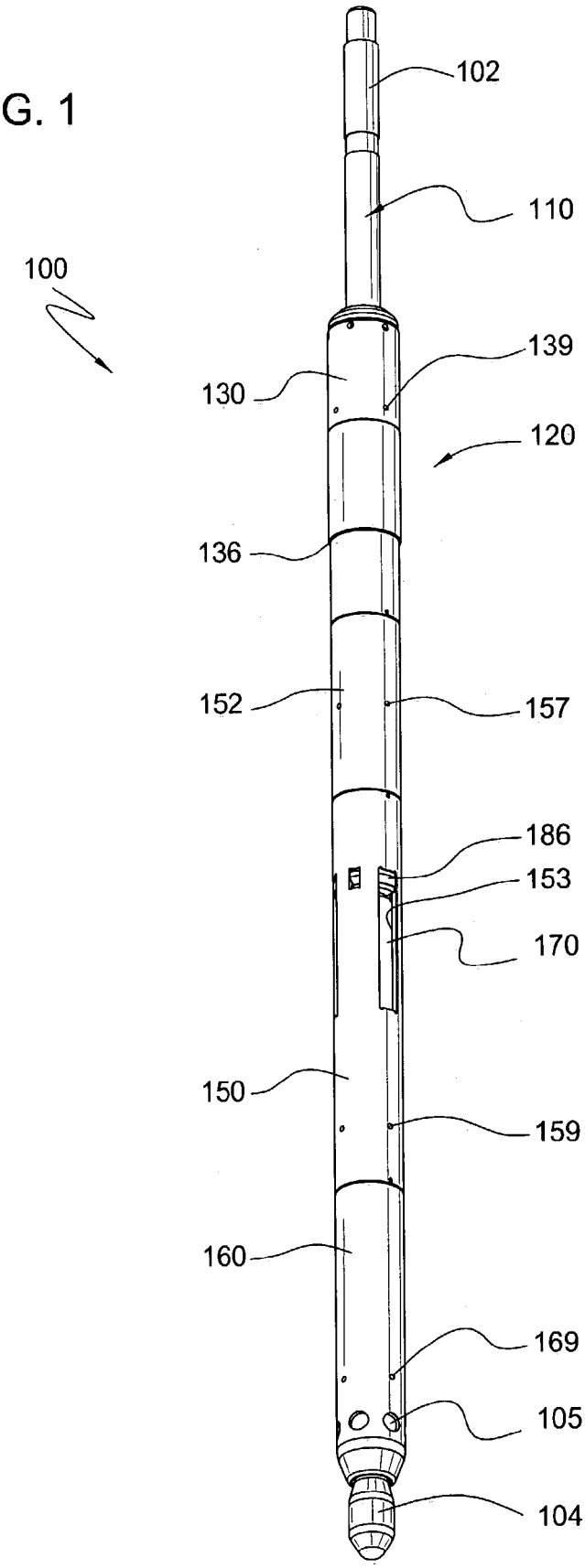
FIG. 1 presents a side elevational view of a permanent lockout tool of the present invention, in one embodiment. The lockout tool is shown in its run-in position.
Figure 15:
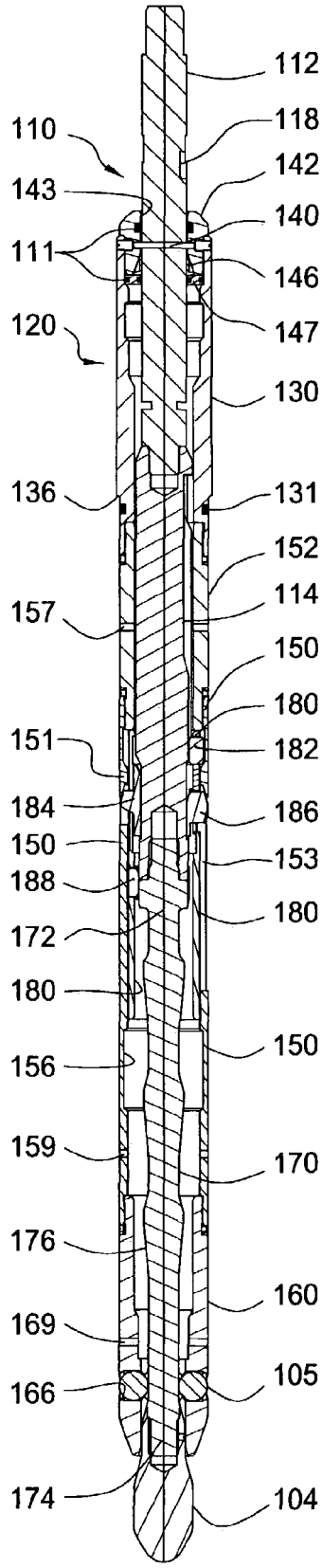

FIG. 15 shows an alternate embodiment for the lockout tool 100 of FIG. 1. In this embodiment, the lockout tool is hydraulically activated. The lockout tool is seen in a side, cross-sectional view.

DETAILED DESCRIPTION OF CERTAIN EMBODIMENTS

FIG. 1 presents a perspective view of a lockout tool 100 of the present invention, in one embodiment. In this view, the lockout tool 100 is shown in its run-in position. The lockout tool 100 is designed to be landed within a tool 50 to be expanded within a hydrocarbon wellbore (not shown in FIG. 1). An example of such a tool is a subsurface safety valve 50 (also not shown in FIG. 1).

The present invention will be described in connection with a tubing retrievable surface controlled subsurface flapper type safety valve. It will be understood, however that the present invention may be used with other types of subsurface safety valves, including those having different type valve closure members such as balls, and those having different type actuation methods, such as subsurface controlled (i.e., velocity, dome charged, and injection) safety valves. In addition, and as will be described in further detail below, the lockout tool may be used to radially expand a selected portion of any tubular into engagement with a surrounding second tubular within a wellbore.

Regardless of the type, the subsurface safety valve 50 ("SSV") will have certain standard features (seen in FIG. 3A). First, the valve 50 will have a pressure containing body 52. This body 52 typically defines an elongated tubular housing having a bore 55 therethrough. The valve 50 will also have a moveable flow tube 54 disposed within the housing 52. The flow tube 54 moves along the longitudinal axis of the housing 52 in order to selectively open and close a valve closure member 60. The valve closure member 60 is commonly referred to as a "flapper plate," or just "flapper."

The flapper 60 is pivotally mounted onto a non-moveable element such as a hard seat 58. The hard seat 58 is mounted within the housing 52, typically below the flow tube 54. The hard seat 58 defines a short tube or ring that is dimensioned to receive the flow tube 54 when the flapper 60 moves to its closed position.

The flow tube 54 is biased in a position that is retracted from the hard seat 58. Likewise, the flapper 60 is biased in its closed position against the hard seat 58. The biasing force is typically provided by a powerful spring (not shown). It is only when the biasing force acting against the flow tube 54 is overcome, that the flow tube 54 can move through the hard seat 58 and open the flapper 60. However, where the SSV 50 malfunctions and the flow tube 54 cannot move through the hard seat 58 in order to urge the flapper 60 open, the lockout tool 100 is employed. Thus, the present invention provides an apparatus for moving the flow tube 54 downward through the hard seat 58, and holding the flapper 60 in its open position. The present invention also provides a method for engaging and mechanically moving the flow tube 54 through the hard seat 58, and then expanding the flow tube 54 into permanent frictional engagement with the surrounding hard seat 58. In this way, the flow tube 54 is locked into a position holding the flapper member 60 permanently in the open position.

Figure 2:
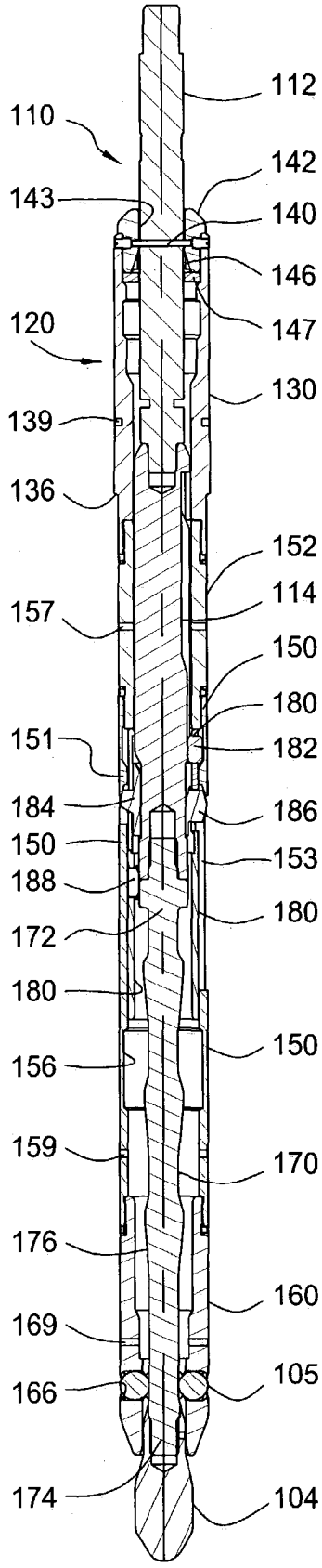
FIG. 2 is a side view of the lockout tool of FIG. 1, in cross-section. More visible in this view are two expander balls at the lower end of the tool. The lockout tool is designed to be mechanically activated.

Referring again to FIG. 1, the lockout tool 100 generally comprises first an elongated stem 110. In one arrangement, the stem 110 defines an upper stem portion 112, and an upper stem extension portion 114, or "stem extension portion." The separate upper stem 112 and upper stem extension 114 portions are seen in FIG. 2. The stem 110 has a top end 102 designed to be connected to a run-in tool, such as a wire line apparatus (not shown). Alternatively, the stem 110 may be deployed at the end of a string of coiled tubing (also not shown).

The lockout tool 100 next comprises a housing 120. In one arrangement, the housing 120 comprises several tubular portions, including a no-go housing 130, an upper housing extension 152, an upper housing 150 and a ball housing 160. These separate housing portions are also shown in FIG. 2. The no go housing 130, upper housing extension 152, upper housing 150, and ball housing 160 together form a single elongated housing 120 configured to receive the stem 110 when the lockout tool 100 is actuated. The use of separate housings 130, 150, 160 assist in assembly of the tool 100.

In the perspective view of FIG. 1, a slot 153 can be seen in the upper housing 150. Preferably, three elongated slots are radially disposed around the upper housing 150. As will be described more fully below, each of the elongated slots 153 receives a flow tube dog 186. The flow tube dogs 186 engage the flow tube 64 of the safety valve 50 in order to drive it downward, thereby placing the flapper 60 in its open position.

Disposed within the housing 120 are a plurality of expander points 105. The expander points 105 in one arrangement are radially disposed within the ball housing 160 at a lower end of the lockout tool 100. In the arrangement described below in connection with FIGS. 4A through 12A, the expander points 105 define radially disbursed balls. The balls 105 are preferably fabricated from a hardened material, such as carbide. As will be shown, the expander balls 105 are urged radially outward against the flow tube 54 (or other tubular to be expanded) in order to "lock" the flapper 60 of the safety valve 50 into its open position. However, it is understood that the expander points 105 may define any outwardly movable protrusion, such as a plurality of hammers, e.g., shaped dogs, placed in an array. FIG. 14 presents a perspective view of an individual hammer 105'.

The lockout tool 100 next comprises an expander mandrel 170. The expander mandrel 170 is connected to a bottom end of the stem extension member 114 within the housing 120. The expander mandrel 170 is urged downwardly relative to the lockout tool housing 120 as the stem 110 is received within the safety valve housing 52. As more fully shown in the cross-sectional view of FIG. 2, the expander mandrel 170 is dimensioned to have a varying diameter, including an enlarged diameter portion 176. As the expander mandrel 170 is urged downwardly within the housing 120, the expander balls 105 are forced to ride outwardly against the diameter 176 of the expander mandrel 170. This causes the balls 105 to expand the flow tube 54 in order to lock the flapper member 60 into its open position. More specifically, the expander balls 105 expand the flow tube 54 of the safety valve 50 into frictional engagement with a surrounding non-movable member, such as the hard seat 58.

Finally, the lockout tool 100 comprises a lower end prong 104. The prong 104 extends through a lower opening in the housing 120, and extends below the housing 120. The lower end prong 104 is used to contact the flapper member 60 in the safety valve 50 as the lockout tool 100 is lowered within the wellbore. In one aspect, the outer diameter of the prong 104 is greater than the inner diameter of the lockout tool housing 120, thereby preventing the expander mandrel 170 from retreating back within the housing 120 upon pullout.

Referring again to FIG. 2, FIG. 2 presents a cross-sectional view of the lockout tool 100 of FIG. 1. Additional details of the lockout tool 100 are seen. First, the upper stem portion 112 is seen. In one arrangement, the upper stem portion 112 defines an elongated solid metal body. In one aspect, the upper stem 112 is a part of a wire line stem used in connection with oil field jars, such as spang jars. The jars are used to hammer downwardly upon a tool within the wellbore by alternately raising the slickline and a connected weighted wire line stem, and dropping the wire line and connected weighted wire line stem upon a steel bar. Thus, the upper stem 112 in the lockout tool 100 may be the steel bar within a set of oilfield jars.

Connected at the lower end of the stem 110 is the stem extension portion 114. In the arrangement of FIG. 2, the stem extension portion 114 also defines an elongated metal shaft. The stem extension 114 has a diameter dimensioned to be slideably received within the housing 120 of the lockout tool 100. Downward force against the stem 110 causes the stem extension member 114 to move downward within (or relative to) the housing 120 of the lockout tool 100.

As noted, the lockout tool 100 also comprises a housing 120. As shown in FIG. 2, the housing 120 defines an elongated tubular body. The housing 120 is divided, in one aspect, into several separate portions. First, the housing comprises a no-go housing 130 at an upper end. The no-go housing 130 has an inner diameter dimensioned to receive the upper stem 112 and the stem extension 114 portions of the stem 110. The no-go housing 130 is connected to the stem 110 via a temporary mechanical connection 140. In the arrangement of FIG. 2, the temporary mechanical connection 140 defines one or more shear pins. Sufficient downward force on the upper stem 112 will cause the shear pin 140 to shear, thereby releasing the upper stem 112 from the no-go housing 130.

A top cap 142 is optionally placed above the no-go housing 130 in order to provide further support for the temporary mechanical connection 140. The top cap 142 has a stem channel 143 that assists in guiding the stem 110 as it slides within the no-go housing 130. An optional lock ring 146 and lock ring spacer 147 are also provided below the top cap 142. The lock ring 146 prevents the upper stem 112 from backing out of the no-go housing 130 due to compression of the power spring (not shown) in the SSV 50 during the tool actuation process.

Optional vents 139 are provided within the no-go housing 130. The vents 139 provide fluid communication between the inner and outer diameter surfaces of the no-go housing 130 during the tool actuation process. This, in turn, further enables the upper stem 112 to move downwardly relative to the housing 120, and to displace any fluid found within the inner diameter of the no-go housing 130, and other housing portions, e.g., upper housing 150.

The housing 120 next comprises an upper housing 150. The upper housing 150 likewise defines an elongated tubular body. The upper housing 150 is disposed below the no-go housing 130. The upper housing 150 includes an inwardly facing shoulder 151 having upper and lower shoulder surfaces. Optional vents 159 are provided within the upper housing 150.

In the arrangement of FIG. 2, an upper housing extension 152 is disposed intermediate the no-go housing 130 and the upper housing 150. An upper end of the upper housing extension 152 is threadedly connected to the no-go housing 130. Similarly, a lower end of the upper housing extension 152 is threadedly connected to the upper housing 150. A separate set of vents 157 is optionally placed within the upper housing extension 152.

Finally, the housing 120 comprises a ball-housing portion 160. The ball housing 160 also defines an elongated tubular member. An upper end of the ball housing 160 is, in one aspect, threadedly connected to a lower end of the upper housing 150. Vents 169 are seen disposed in the ball housing 160. In its lower end, the ball housing 160 includes a recess 166 for receiving a plurality of expander balls 105. As noted, and as will be explained in greater detail below, the expander balls 105 are urged radially outward against the non-moveable element 58 of the safety valve 50 when the lockout tool 100 is actuated.

As noted, the lockout tool 100 of FIG. 1 and FIG. 2 next comprises an expander mandrel 170. The expander mandrel 170 has an upper end 172 and a bottom end 174. The upper end 172 of the expander mandrel 170 is connected to a lower end of the stem extension member 114. The lower end 174 of the expander mandrel 170, in turn, extends proximate to the lower end of the ball housing 160. The lower end 174 of the expander mandrel 170 includes a lower end prong 104 that extends below the ball housing 160. In one aspect, the lower end prong 104 is a separate piece threadedly connected to the lower end 174 of the expander mandrel 170. In the particular arrangement shown in FIG. 2, and as noted above, the lower end prong 104 has an outer diameter that is greater than the inner diameter of the ball housing 160. This further helps to keep the stem 110 (including the stem extension 114) and inner mandrel 170 from retracting upward relative to the lockout tool housing 120, especially during pullout.

In order to enable and assist the movement of the stem 110 and the inner mandrel 170 within the housing 120, various dogs are employed. These preferably include (1) at least one carrier sleeve locking dog 182; (2) at least one locking dog 184; (3) at least one flow tube dog 186; and (4) at least one carrier sleeve no-go dog 188. Those of ordinary skill in the general art of designing wellbore tools will understand that dogs are utilized to provide releasable connections between tubular members. Dogs may be biased inward or outward in order to selectively achieve relative movement between tubular members upon release. Alternatively, dogs may not be biased, but are urged to move in response to forces from adjacent tubular members.

The dogs 182, 184, 186, 188 of the present invention are carried along by a sleeve 180. The carrier sleeve locking dog 182, the flow tube dog 186 and the carrier sleeve no-go dog 188 are connected via a carrier sleeve 180, while the locking dog 184 resides adjacent the carrier sleeve 180. The relative functions of the carrier sleeve locking dogs 182, the locking dogs 184, the flow tube dogs 186 and the carrier sleeve no-go dogs 188 should be noted here. The carrier sleeve locking dogs 182 serve to prevent the carrier sleeve 180 from moving before a lower shoulder 119 of the upper stem extension 114 contacts the carrier sleeve no-go dogs 188. The locking dogs 184 serve to maintain the position of the lockout tool 100 within the safety valve 50 during the lockout process. The flow tube dogs 186 land on top of the flow tube 54 and drive the flow tube 54 downward. Finally, the carrier sleeve no-go dogs 188 shift the carrier sleeve 180 downward when contacted by the lower shoulder 119 of the upper stem extension 114.

The precise functions of the various dogs are more fully understood in light of the cross-sectional views of FIGS. 3A–12A, discussed below. More specifically, FIGS. 3A–12A provide a step-by-step presentation for actuation of the lockout tool 100. It should again be noted that certain parts in the drawings are sometimes darkened. This indicates that the part is either moving, or is about to be moved.

FIG. 3A presents a cross-sectional view of a lockout tool 100 of the present invention, in one arrangement. In this view, the lockout tool 100 has been landed in a subsurface safety valve 50. The SSV 50 itself includes a housing 52, a bore 55 within the housing, a non-moveable element 58 (such as a hard seat) and a valve closure member 60, i.e. "flapper" pivotally mounted onto the hard seat 58. The flapper 60 resides within the bore 55, and is movable between an opened position and closed position. The safety valve 50 also includes a flow tube 54 axially moveable within the bore 55 of the housing 52 for controlling the movement of the flapper 60, and an actuator, e.g., piston 57, for translating the flow tube 54 longitudinally. Certain features of a typical SSV 50, such as the hydraulic flow line and a spring biasing the flow tube 54 upwardly, are not shown. More details concerning features of the safety valve itself, in one arrangement, are described in U.S. patent application Ser. No. 09/998,800. Named inventors on that pending application are Deaton and Jancha.

As shown in FIG. 3A, the lockout tool 100 has been lowered into the safety valve 50 to a depth such that the lower end prong 104 has contacted the flapper 60. Further, the lower end prong 104 has forced the flapper 60 partially open. The injection of fluid at a rate sufficient to equalize the pressure above and below the flapper 60 within the wellbore may be provided to aid in opening the flapper 60. In one arrangement, the lockout tool 100 may be lowered into the wellbore using coiled tubing in lieu of a wire line tool, with pressure being injected into the wellbore through the coiled tubing.

In order to properly land the lockout tool 100 into the flapper valve 50, a locating shoulder 136 is fabricated into the outer diameter of the no-go housing 130. The locater shoulder 136 matches a beveled shoulder provided in a typical subsurface safety valve 50. In this manner, the lockout tool 100 may be dropped to the appropriate position within the safety valve 50 in order to conduct the expansion operation of the present invention. More specifically, the expander balls 105 are located at a depth that parallels the location of the non-moveable member, e.g., hard seat 58 of the safety valve 50. In the view of FIG. 3A, the expander balls 105 are located adjacent the hard seat 58 immediately above the flapper 60.

In the position of the lockout tool 100 in FIG. 3A, a downward force has not yet been applied against the stem 110. It can be seen that the shear pin 140 has not yet been broken. Thus, the upper 112 and lower 114 stem members and inner mandrel 170 are held in place relative to the lockout tool housing 120. It can also be seen that the carrier sleeve locking dog 182, the locking dog 184, the flow tube dog 186 and the carrier sleeve no-go dog 188 are each in their run-in position, in accordance with FIG. 2.

FIG. 3B is a cross-sectional view of the lockout tool 100 of FIG. 3A. The tool 100 is landed within the valve housing 52. The view of FIG. 3B is taken across line B—B. More visible in this view are three carrier sleeve locking dogs 182 disposed within the upper housing 150. The three carrier sleeve locking dogs 182 are supported by slots 115 machined into the stem extension 114. The stem extension 114 is seen within the carrier sleeve locking dogs 182.

FIG. 3C presents a cross-sectional view of the lockout tool of FIG. 3A, taken across line C—C of FIG. 3. Line C—C is just below line B—B, and is cut across the flow tube dogs 186 and the locking dogs 184. Visible in this view are both flow tube dogs 186 and locking dogs 184 radially disbursed around the stem extension 114, and carried by the carrier sleeve 180. A hydraulic chamber 56 is seen in the valve housing 52. A piston 57 is seen within the hydraulic chamber 56.

FIG. 3D provides a cross-sectional view of the lockout tool of FIG. 3A, with the view taken across line D—D of FIG. 3A. Line D—D is just below line C—C, and is cut across the no-go dogs 188. In this view, the carrier sleeve no-go dogs 188 are seen disposed within the upper housing 52 and the flow tube 54, and around the expander mandrel 170. The no-go dogs 188 are carried by the carrier sleeve 180.

Finally, FIG. 3E shows another a cross-sectional view, taken across line E—E of FIG. 3. Line E—E is cut across the lower end 174 of the expander mandrel 170. Visible in this view are the plurality of expander balls 105 radially disbursed around the expander mandrel 170. In this arrangement, six balls 105 are provided, though more or less may be employed. The balls 105 reside within recesses 166 in the ball housing 160. A surrounding string of production tubing 70 is seen. However, the flow tube 54 is not seen, as it has not yet been driven downwardly.

Moving now to FIG. 4A, FIG. 4A presents a cross-sectional view of the lockout tool 100 of FIG. 3A. In this view, the lower stem 114 is beginning to be pushed downward into the valve housing 52. As noted, the stem 110 may be urged downward by mechanical forces applied through spang jars. Alternatively, hydraulic pressure provided through a working string such as coiled tubing (not shown) may act against the stem. The shear pin 140 supporting the upper stem 112 has been sheared. Downward movement of the upper stem 112, in turn, exerts downward force against the lower stem 114. It can also be seen that a lower shoulder 119 in the stem extension 114 is acting downwardly against the locking dogs 184. Further downward movement will cause the locking dogs 184 to move out into a recess 53 within the valve housing 52.

FIG. 4B is a cross-sectional view of the lockout tool of FIG. 4A. The view is taken across line B—B of FIG. 4A. Visible again in this view are the three carrier sleeve locking dogs 182 pushing outwardly against the upper housing 150. The locking dogs 182 remain disposed around the stem 114, carried by the carrier sleeve 180.

FIG. 4C presents a cross-sectional view of the lockout tool of FIG. 4, taken across line C—C. Visible again are the flow tube dogs 186 and locking dogs 184 radially disbursed around the stem extension member 114, and carried by the carrier sleeve 180. The flow tube dogs 186 and locking dogs 184 are darkened to indicate downward movement. The locking dogs 184 have not yet backed outwardly, but remain adjacent the stem extension 114.

FIG. 4D provides a cross-sectional view of the lockout tool 100 of FIG. 4A, shown across line D—D of the figure. Visible again in this D—D view are carrier sleeve no-go dogs 188 disposed within the valve's hard seat 58, and around the expander mandrel 170. In the view, both the stem extension member 114 and the expander mandrel 170 are seen within the carrier sleeve no-go dogs 188. The no-go dogs 188 are retained in this step by the upper housing 150. The flow tube 54 is seen around the upper housing 150.

Finally, FIG. 4E shows a cross-sectional view of the lockout tool of FIG. 4A, taken across line E—E. The plurality of expander balls 105 are again seen around the expander mandrel 170. There is no change in the relative position of the expander balls 105 as compared to FIG. 3E. In this regard, the expander balls 105 remain retracted against the smaller diameter of the expander mandrel 170 at its lower end 174.

Moving to the next step in the tool actuation process, FIG. 5A presents the lockout tool 100 of FIG. 4A, again in cross-section. In this view, the stem 110 continues to be driven downward into the lockout tool 100. This allows the locking dogs 182 to clear both the lower shoulder 119 in the stem extension member 114 and the shoulder 151 in the upper housing 150 as the stem 110 is driven further downward. The locking dogs 182 have now been urged outwardly along the stem extension member 114, and have engaged the profile 53 in the safety valve housing 52.

FIG. 5B presents a cross-sectional view of the lockout tool 100 of FIG. 5A. The view is taken across line B—B of FIG. 5A. The three carrier sleeve locking dogs 182 are again seen pushing outwardly towards the upper housing 150. There is no relative change in the position of the carrier sleeve locking dogs 182 as compared to FIG. 4B.

FIG. 5C provides a cross-sectional view of the lockout tool 100 of FIG. 5A, with the view taken across line C—C. Seen in this view again are the flow tube dogs 186 and the locking dogs 184 radially disposed around the stem extension member 114, and carried by the carrier sleeve 180. It can be seen that the locking dogs 184 have popped outwardly into the profile 53 of the valve housing 52.

FIG. 5D demonstrates a cross-sectional view of the lockout tool 100 of FIG. 5A, taken across line D—D of FIG. 5A. The carrier sleeve no-go dogs 188 are again shown disposed within the valve housing 52. Both the stem extension member 114 and the upper end 172 of the expander mandrel 170 are again seen within the carrier sleeve no-go dogs 188.

Finally, FIG. 5E shows a cross-sectional view of the lockout tool 100 of FIG. 5A, cut through line E—E of FIG. 5A. The plurality of radially disbursed expander balls 105 are again shown. There is no change in the radial position of the expander balls 105 as compared to FIGS. 3E and 4E.

The next step in the tool actuation process is presented in FIG. 6A. FIG. 6A presents a cross-sectional view of the lockout tool 100 of FIG. 5A. The stem extension member 114 continues to be driven downward into the lockout tool 100. In this view, the flow tube dogs 186 have also moved outwardly into the recess 53 in the valve housing 52. This enables the flow tube dogs 186 to be positioned above the piston 54.

FIG. 6B provides a cross-sectional view of the lockout tool 100 of FIG. 6A. The view is taken across line B—B of FIG. 6A. Again visible are three carrier sleeve locking dogs 182 pushing outward against the upper housing 150. There is no relative change in position of the carrier sleeve locking dogs 182 as compared to FIG. 5B.

FIG. 6C demonstrates a cross-sectional view of the lockout tool 100 of FIG. 6A, cut through line C—C. In this view, it can be seen that both the flow tube dogs 186 and the locking dogs 184 have expanded outwardly relative to the stem extension member 114. The flow tube dogs 186 and locking dogs 184 extend into the recess 53 of the valve housing 52.

FIG. 6D shows a cross-sectional view of the lockout tool 100 of FIG. 6A, taken across line D—D. Visible now in the center of this view is the lower stem 114, partially in cross-section, and partially looking at the bottom end. This further confirms downward movement of the stem 110 into the valve 50. The expander mandrel 170 is no longer seen, as it has been urged below line D—D.

Finally, FIG. 6E presents a cross-sectional view of the lockout tool 100 of FIG. 6A, as shown through line E—E of FIG. 6A. While the stem 110 and connected expander mandrel 170 have moved downward, the enlarged outer diameter portion 176 of the expander mandrel 170 has not yet contacted the plurality of expander balls 105. Thus, there is no change in the relative position of the expander balls 105 as compared to FIG. 3E.

Moving now to FIG. 7A, FIG. 7A presents a cross-sectional view of the lockout tool 100 of FIG. 6A. In this view, the lower stem 114 continues to be driven still further into the lockout tool 100. This has enabled the carrier sleeve locking dogs 182 to clear an upper shoulder 116 of the stem extension member 114. In addition, the locking dogs 184 remain in the recess 53 in the valve housing 52.

FIG. 7B provides a cross-sectional view of the lockout tool 100 of FIG. 7A. Here, the view is taken across line B—B of FIG. 7A. Again visible in this view are the three carrier sleeve locking dogs 182 carried by the carrier sleeve 180. It can be seen that the carrier sleeve locking dogs 182 have been able to move inwardly due to the reduced outer diameter 116 and the slots 115 of the stem extension member 114.

FIG. 7C is a cross-sectional view of the lockout tool 100 of FIG. 7A, taken across line C—C. Shown again in this view are the flow tube dogs 186 and locking dogs 184 radially disbursed around the stem extension member 114. An enlarged outer diameter portion 117 of the stem extension 114 is adjacent both the flow tube dogs 186 and the locking dogs 184, thereby urging these dogs 186, 184 outwardly towards the valve housing 52 and into the recess 53.

FIG. 7D provides a cross-sectional view of the lockout tool 100 of FIG. 7A, now taken across line D—D. Visible again in this view are carrier sleeve no-go dogs 188 carried by the carrier sleeve 180. The stem extension member 114 within the carrier sleeve no-go dogs 188 is now a solid body, shown in cross-section. It should also be noted from FIG. 7A that the lower shoulder 119 of the stem extension 114 has now engaged the carrier sleeve no-go dogs 188. As will be shown, as the stem 110 is urged further downward, the shoulder 119 will push the carrier sleeve no-go dogs 188 and attached carrier sleeve 180 downward as well. This, in turn, pulls the flow tube dogs 186 downward, allowing the flow tube dogs 186 to drive the flow tube 54 downward.

Finally, FIG. 7E shows a cross-sectional view of the lockout tool 100 of FIG. 7A, taken across line E—E of FIG. 7A. There is again no change in the relative position of the expander balls 105, even as compared to FIG. 3E.

The next step in the tool actuation process is shown in FIG. 8A. FIG. 8A presents the lockout tool 100 of FIG. 7A, in cross-section. In this view, the stem 110 continues to be driven downward into the housing 120 for the lockout tool 100. The flow tube dogs 186 have extended further downwardly and are above the flow tube 54 of the safety valve 50.

This will allow the flow tube dogs 186 to exert downward force against the flow tube 54. The flow tube dogs 186 move downwardly within respective slots (seen at 153 in FIG. 1) in the upper housing 150.

FIG. 8B provides a cross-sectional view of the tool 100 of FIG. 8A. Here, the view is taken across line B—B of FIG. 8A. Three carrier sleeve locking dogs 182 are again visible along the carrier sleeve 180. It is noted that the stem extension member 114 has been driven downward to the degree that the enlarged outer diameter portion 117 of the stem extension 114 has cleared the carrier sleeve locking dogs 182. The diameter of the stem extension 114 is again reduced.

FIG. 8C shows a cross-sectional view of the lock out tool 100 of FIG. 8A, cut across line C—C. The flow tube dogs 186 and locking dogs 184 are again seen radially disposed about the carrier sleeve 180. The flow tube dogs 186 are fully expanded outwardly against the inner diameter of the safety valve housing 52, and are exerting downward force against the flow tube 54.

FIG. 8D gives a cross-sectional view of the lock out tool 100 of FIG. 8A, shown through line D—D of FIG. 8A. The carrier sleeve no-go dogs 188 are seen riding with the carrier sleeve 180. The diameter of the stem extension 114 within the tool 100 is the same, as the enlarged outer diameter portion 116 of the stem extension member 114 has not yet reached the level of the carrier sleeve no-go dogs 188.

FIG. 8E shows a cross-sectional view of the tool 100 of FIG. 8A, taken across line E—E. There still remains no visible change in the relative position of the expander balls 105 as compared to FIG. 3E.

The next step in the tool actuation process is seen in FIG. 9A. FIG. 9A presents yet another cross-sectional view of the lockout tool 100. In this view, the stem 110 continues to be driven downward into the safety valve 50. The carrier sleeve 180 and connected flow tube dogs 186 are shown driving the flow tube 54 downward towards the flapper 60. The flow tube 54 is now visible around the ball housing 160. Also, the shoulder 119 of the stem extension member 114 is driving the carrier sleeve no-go dogs 188 and connected carrier sleeve 180 further downward.

FIG. 9B provides a cross-sectional view of the tool of FIG. 9A, with the view being taken across line B—B. The carrier sleeve locking dogs 182 continue to ride along the carrier sleeve 180. The carrier sleeve locking dogs 182 have moved downward adjacent to the locking dogs 184. Thus, the locking dogs 184 are seen disposed adjacent the carrier sleeve locking dogs 182 around the carrier sleeve 180.

FIG. 9C shows a cross-sectional view of the lockout tool 100 of FIG. 9A. Here, the view is shown across line C—C. The flow tube dogs 186 are fully expanded outwardly against the inner diameter of the safety valve housing 52, and exert downward force against the flow tube 54 as described above. The flow tube 54 is now visible around the ball housing 160.

FIG. 9D demonstrates a cross-sectional view of the lockout tool 100 of FIG. 9A. The cut is taken across line D—D. Visible in this view are carrier sleeve no-go dogs 188 disposed within the flapper valve housing 52, and around the expander mandrel 170. The carrier sleeve no-go dogs 188 continue to be driven downward by the stem 110, including the stem extension member 114.

FIG. 9E is a cross-sectional view of the lockout tool 100 of FIG. 9A, taken across line E—E. There remains no change in the relative position of the expander balls 105 as compared to FIG. 3E. However, the flow tube 54 is now visible around the ball housing 160.

FIG. 10A presents the next step in the actuation process for the lockout tool 100 after the step of FIG. 9A. FIG. 10A provides a cross-sectional view of the tool 100. In this view, the stem 110 has been driven further downward into the housing 52 for the safety valve 50. The flow tube dogs 186 have now moved downward to the end of their stroke. In the arrangement of FIG. 10A, the flow tube dogs 186 and connected carrier sleeve 180 stroke out when the flow tube 54 reaches the end of its stroke. At this point, of course, the safety valve flapper 60 is completely opened. The lower shoulder 119 of the enlarged outer diameter portion 117 of the stem extension member 114 remains in contact with the carrier sleeve no-go dogs 188 so as to drive them downward. However, the carrier sleeve no-go dogs 188 are now aligned with a recess 57 in the upper housing 150. As will be seen in FIG. 11A, this will allow the carrier sleeve no-go dogs 188 to move outwardly.

FIG. 10B provides a cross-sectional view of the lockout tool of FIG. 10A, taken across line B—B. The carrier sleeve locking dogs 182 continue to move downward through the safety valve housing 52 with the stem 110 and the carrier sleeve 180.

FIG. 10C shows a cross-sectional view of the tool 100, with the view being taken through line C—C of FIG. 10A. The flow tube dogs 186 remain visible, and remain fully expanded outwardly against the inner diameter of the safety valve housing 52. The flow tube dogs 186 also remain shouldered out against the top of the upper housing 150.

FIG. 10D demonstrates a cross-sectional view of the lockout tool 100, cut through line D—D of FIG. 10A. The carrier sleeve no-go dogs 188 continue to be driven downwardly by the shoulder 119 in the stem extension member 114.

FIG. 10E shows the lockout tool of FIG. 10A, in cross-section. The view is taken across line E—E. There is again no change in the position of the expander balls 105 relative to the flow tube of the safety valve as compared to FIG. 3E. The flow tube 54 remains visible circumferentially around the ball housing 160, keeping the flapper member 60 in its fully open position.

The next step in the tool actuation process is seen in FIG. 11A. FIG. 11A presents yet another cross-sectional view of the lockout tool 100. In this view, the stem 110 is still driving further downward into the safety valve 50. The carrier sleeve no-go dogs 188 have been urged outwardly into the recess 57 in the upper housing 150. This allows the stem extension member 114 to move downwardly within both the carrier sleeve 180 and the flow tube 54. This, in turn, drives the expander mandrel. 170 further downward. As noted, the expander mandrel 170 includes an enlarged diameter portion 176 that acts against the expander balls 105. The enlarged diameter portion 176 can be seen now acting against the balls 105, and driving them outwardly into the flow tube 54 of the safety valve 50.

FIG. 11B provides a cross-sectional view of the lockout tool 100 of FIG. 11A, taken across line B—B of FIG. 11A. The position of the carrier sleeve locking dogs 182 relative to the tool housing 120 has not changed from the view of FIG. 10B.

FIG. 11C shows the lockout tool 100 of FIG. 11A, in cross-section. The view is taken across line C—C. There is also no change in the position of the flow tube dogs 186 relative to the tool housing 120.

FIG. 11D gives another cross-sectional view of the tool 100 of FIG. 11A. Here, the view is taken across line D—D. The carrier sleeve no-go dogs 188, which have popped outwardly into the recess 57 of the upper housing 150, are adjacent the enlarged diameter portion 117 of the stem extension member 114.

Finally, FIG. 11E provides a cross-sectional view through line E—E. The plurality of expander balls 105 are again seen. It can be seen that the diameter of the expander mandrel 170 has been enlarged relative to the diameter shown in previous "E—E" cross-section views. This causes the expander balls 105 to be expanded outward against the flow tube 54 of the safety valve 50. In the arrangement of FIG. 11A, the expander balls 105 have also begun to pinch the flow tube 54 into the non-moveable hard seat 58 of the safety valve 50. This creates a profile in the hard seat 58 where it receives the flow tube 54, thereby strengthening the frictional "lock" between the flow tube 54 and the seat 58. This, in turn, maintains the flow tube 54 in its lowered position adjacent the flapper 60. In this manner, the flapper 60 is locked in its open position.

FIG. 12A presents a final cross-sectional view of the lockout tool 100, and provides the final step in the lockout process. In this view, the expander mandrel 170 has been driven through the flapper 60 of the safety valve. A reduced inner diameter portion of the mandrel 170 has reached the depth of the expander balls 105 within the ball housing 160. This has allowed the expander balls 105 to recess back within the ball housing 160, and the flow tube dogs 186 to retract. This, in turn, allows the entire tool 100 to later be removed from the wellbore with tension placed in the slickline.

The stem extension member 114 has passed below the locking dogs 184 such that the top end of the stem extension 114 forms a shoulder below the locking dogs 184. This allows the operator to pull the housing 120 and stem 110 of the tool 100 after the lockout process is completed.

FIG. 12B is a cross-sectional view of the tool 100 of FIG. 12A, taken across line B—B. The stem 110 has been moved through the tool housing 120 to the extent that the top end of the stem extension member 114 is adjacent the locking dogs 184. The three locking dogs 182 are shown in FIG. 12B disposed around the stem extension member 114. The bottoms of the carrier sleeve locking dogs 182 are visible in this cut.

FIG. 12C provides a cross-sectional view taken across line C—C of FIG. 12A. It can be seen that the flow tube dogs 186 have cleared the enlarged diameter portion 117 of the stem extension member 114, and are recessing inward.

FIG. 12D shows the tool of FIG. 12A in cross-section, with the view being taken across line D—D. The enlarged outer diameter portion 176 of the expander mandrel 170 has moved below the carrier sleeve no-go dogs 188. The carrier sleeve no-go dogs 188 are again seen around the stem extension member's 114 diameter.

FIG. 12E shows the lockout tool 100, in cross-section, with the view being taken across line E—E of FIG. 12A. The expander balls 105 have retracted and are no longer expanding the radial dimension of the flow tube 54.

It can be seen that the expansion of the flow tube 54 of the safety valve 50 takes place radially. However, as best shown in the cross-sectional view of FIG. 11E, the expansion is not completely circular. In the particular arrangement shown in FIG. 11E, six expander balls 105 are used in order to contact the surrounding flow tube 54 and expand it outwardly against the seat 58. In order to provide a more complete expansion, it is desirable to be able to rotate the ball housing 160 at least 60° in order to effectuate a completely circular expansion. Accordingly, an alternate embodiment of the present invention is provided which allows partial rotation of the ball housing 160 during the lockout tool actuation process.

FIG. 13 presents a section view of an alternate embodiment of the lockout tool 100 of the present invention. In this view, a grooved and spiraled spline 175 is placed around the expander mandrel 170 at the level of the enlarged outer diameter portion 176. A bearing connection 165 is provided between the ball housing 160 and the lower end 154 of the upper housing 150. The allows the ball housing 160 to rotate. Downward force urged against the expander mandrel 170 causes the expander balls 105 to engage the grooved and spiraled spline 175. This moves the balls outward into engagement with the inner diameter of the flow tube 54. Further downward jarring causes not only initial deformation of the flow tube 54, but also rotation of the ball housing 160 and expander balls 105. Still further rotation and expansion results in a flow tube 54 diameter having an expanded circumferential band. This provides an even more secure frictional engagement of the flow tube 54 against the surrounding non-moveable hard seat 58 within the safety valve 50.

As can be seen, an improved lockout tool for locking a subsurface safety valve in the open position has been provided. While certain embodiments of the lockout tool have been described and demonstrated herein, it is understood that this description is not intended to limit the scope of the invention, but that the actual scope of the invention is determined by the claims, which follow. Accordingly, other and further embodiments of the lockout tool may be provided that are within the spirit and scope of the present invention.

It is also understood that the lockout tool has utility outside of the context of safety valves. For example, the lockout tool may be inserted into any tubular member for which expansion is desired. For example, it may be desirable to expand a short section of tubing into frictional engagement with a surrounding string of casing in order to form a casing patch. In such an operation, the lockout tool would provide an initial expansion of the tubing section into frictional engagement with the surrounding casing. The lockout tool would then be removed from the wellbore, and a rotary expander tool would be inserted in its place. For a further discussion of the use of a rotary expander tool for installing a coiled tubing patch in another context, the reader is referred to U.S. patent application Ser. No. 10/106,178 entitled "Method for Installing an Expandable Coiled Tubing Patch." The named inventor therein is Hoffman.

The rotary expander tool (not shown) is lowered to a depth adjacent the tubing section (not shown). Thereafter, the expander tool is actuated in order to further expand the tubing section into frictional engagement with the surrounding casing. The expander tool is further rotated and translated along a desired length within the wellbore in order to accomplish a complete expansion. In this manner, a tubing patch may be installed.

Other expansion applications are also contemplated within the present invention. In this regard, the tubing patch application represents only one such application. Again, the lockout tool may be employed to initially expand a portion of one tubular member into frictional engagement with another surrounding tubular member of any type.

It should also be noted that the lockout tool 100 of the present invention is not limited to a mechanically activated tool. The lockout tool 100 shown in FIG. 2 and the various step-drawings that follow is mechanically activated. In this respect, the stem 110 and connected expander mandrel 170 are urged downward through the SSV 50 using spang jars or other mechanical-force-delivering tool. However, the tool 100 can be quickly modified for hydraulic actuation.

FIG. 15 shows an alternate embodiment for the lockout tool 100 of FIG. 1. In this embodiment, the lockout tool 100' is hydraulically activated. The lockout tool 100' is seen in a side, cross-sectional view. In order to effectuate a hydraulic activation, various seals are placed along the lockout tool 100'. First, a seal 131 is placed along the outer diameter of the elongated housing 120. This serves to seal the interface between the lockout tool 100' and a run-in tool (not shown) connected with the working string (also not shown). In the arrangement of FIG. 15, the seal 131 is disposed at the lower end of the no-go housing 130.

Next, seals 111 are placed along the channel 143 between the outer diameter of the stem 110 and the inner diameter of the housing 120. When the tool 100' is in the run-in position of FIG. 15, the seals 111 serve to prevent hydraulic fluid from passing into the interface between the stem 110 and the housing 120. In the arrangement of FIG. 15, one seal 111 is disposed within the top cap 142 to seal around the slidable upper stem 112, while another seal 111 is disposed around the upper stem 112 within the lock ring spacer 147.

The lockout tool 100' of FIG. 15 also includes a pressure relief groove 118. As will be described further below, the pressure relief groove 118 allows fluid to temporarily vent once the lockout tool 100' has been hydraulically actuated.

The modified lockout tool configuration of FIG. 15 is ideal for use in deviated wells where mechanical actuation of a lockout tool would be difficult. In operation, the upper stem 112 is connected to the lower end of a working string (not shown). For deviated wellbore operations, the working string is most likely a string of coiled tubing. A run-in tool is used that provides a seal between the inner diameter of the coiled tubing and the outer diameter of the housing 120. The lockout tool 100' is then run into the wellbore and landed into the housing of a safety valve (not shown in FIG. 15).

Once the lockout tool 100' is landed into position, hydraulic fluid is pumped into the coiled tubing. As pressure increases within the sealed coiled tubing, the top of the upper stem 112 begins to act as a piston surface. The stem 112 and connected expander mandrel 170 are then urged downwardly within the SSV 50. As described above in connection with FIGS. 3A and 4A, a temporary mechanical connection 140 is provided between the stem 110 and the no-go housing 130. Hydraulic pressure acting on the upper stem 112 will increase, ultimately causing the temporary connection 140 to break. The pressure relief groove 118 along the upper stem 112 will reach the upper cap 142, allowing hydraulic pressure to temporarily bleed. This informs the operator that the temporary mechanical connection 140 has been broken and the stem 110 and connected expander mandrel 170 are moving. The lockout tool 100' then progresses through the safety valve 50 as described above in connection with FIGS. 5A–12A in order to permanently open the flapper valve 60.

It is also noted that a combination of mechanical and hydraulic force may be used to activate the lockout tool 100. In this method, jars are used to break the temporary connection 140. The coiled tubing is then pressured up in order to finish lockout. The pressure option may also be used to release a lockout tool 100 that has become stuck in a deviated wellbore during run-in.

We claim:

1. A lockout tool for locking a subsurface safety valve in the open position, wherein the safety valve comprises a pressure containing body having a bore therethrough, a valve closure member disposed in the bore moving between an open and a closed position, a flow tube axially moveable in the body, a non-moveable seat adjacent the valve closure member, and an actuating means for translating the flow tube longitudinally in the bore, said lockout tool comprising:

an elongated housing adapted to fit inside the subsurface safety valve; a mandrel moveable in the housing;

at least one dog, which, upon controlled movement of the mandrel, engages and moves the flow tube in a direction to place the valve closure member in its open position; and a plurality of expander points in substantially circumferential arrangement inside the housing, and adapted to move into radial engagement with an inside diameter of the flow tube after the at least one dog has moved the flow tube to open the valve closure member in its open position, said expander points being urged to move radially outward with sufficient force to yield and expand a diametrical portion of the flow tube into engagement with the non-moveable seat in the safety valve, thereby permanently locking the valve closure member in the open position.

2. The lockout tool of claim 1, wherein the housing comprises a ball housing portion that houses the plurality of expander points.

3. The lockout tool of claim 2, wherein the expander points define balls.

4. The lockout tool of claim 2, wherein the expander points define dogs.

5. The lockout tool of claim 1, wherein the housing defines a plurality of sub-housings.

6. The lockout tool of claim 5 wherein the plurality of sub-housings comprises: a no-go housing, the no-go housing having an outer beveled surface for landing onto a beveled profile along the inner surface of the safety valve; an upper housing, with at least one dog residing within the upper housing; and a ball housing, the expander points residing along the ball housing.

7. The lockout tool of claim 6, further comprising a stem at least partially slidably received within the housing.

8. The lockout tool of claim 7, wherein the stem comprises an upper portion configured to be coupled to a run-in tool, and a lower extension portion coupled to the mandrel.

9. The lockout tool of claim 8, wherein the upper portion of the stem is a part of a wire line stem used in connection with oil field jars.

10. The lockout tool of claim 8, wherein the upper portion of the stem is connected to a string of coiled tubing for run-in.

11. The lockout tool of claim 7, wherein: the lookout tool further comprises a carrier sleeve axially movable within the housing; and the at least one dog comprises at least one flow tube dog carried by the carrier sleeve within the housing.

12. The lockout tool of claim 11, wherein the lockout tool further comprises at least one locking dog for maintaining the position of the lockout tool within the safety valve during the lockout process.

13. The lockout tool of claim 12, wherein the locking dog is also carried by the carrier sleeve.

14. The lockout tool of claim 13, wherein the lookout tool further comprises at least one carrier sleeve no-go dog carried by a carrier sleeve within the housing, the at least one carrier sleeve no-go dog shifting the carrier sleeve downward in response to downward movement of the stem.

15. The lockout tool of claim 14, wherein the stem further comprises a shoulder for contacting the carrier sleeve no-go dog when the stem is urged downward, thereby contacting the at least one carrier sleeve no-go dog and urging the carrier sleeve downward.

16. The lockout tool of claim 15, wherein the lockout tool further comprises at least one carrier sleeve locking dog for preventing the carrier sleeve from moving before the shoulder of the stem contacts the at least one carrier sleeve no-go dog.

17. The lockout tool of claim 1, wherein the mandrel is moveable in the housing in response to mechanical force.

18. The lockout tool of claim 1, wherein the mandrel is moveable in the housing in response to hydraulic force.

19. A lockout tool for locking a subsurface safety valve in the open position, the safety valve comprising a housing having a bore therethrough, a flapper member disposed in the bore, the flapper being movable between an open position and a closed position by a flow tube, a non-moveable seat adjacent the flapper member, and an actuating means for translating the flow tube longitudinally in the bore in order to maintain the flapper in the open position, the lockout tool comprising:

an elongated housing dimensioned to be received within the subsurface safety valve, the housing having a bore therethrough, and having a recess;

a mandrel received within the bore of the housing, and being moveable along a longitudinal axis of the housing, the mandrel including an enlarged diameter portion; and a plurality of expander points radially disposed within the recess of the housing, the expander points being arranged to ride along the mandrel as the mandrel is received within the lockout tool housing, and to be urged outwardly as the enlarged diameter portion of the mandrel passes through the plurality of expander points, thereby causing the expander points to engage an inside diameter of the flow tube such that the expander points expand a diametrical portion of the flow tube into engagement with the non-moveable seat so as to look the flapper in the open position.

20. The lockout tool of claim 19, further comprising:

at least one dog which, upon controlled movement of the mandrel, engages and moves the flow tube in a direction to maintain the flapper in the open position.

21. The lockout tool of claim 19, wherein the expander points define balls.

22. The lockout tool of claim 19, wherein the expander points define dogs.

23. A method for locking a subsurface safety valve in the open position, the safety valve comprising a housing having a bore therethrough, a flapper member disposed in the bore, the flapper member being movable between an open position arid a closed position by a flow tube, a non-moveable seat substantially surrounding the flow tube, and an actuating means for translating the flow tube longitudinally in the bore in order to maintain the flapper member in the open position, the method comprising the steps of:

running a lookout tool into a wellbore, the lockout tool comprising:

an elongated housing dimensioned to be received within the subsurface safety valve, the housing having a bore therethrough, and having a recess;

a mandrel received within the bore of the housing, and being moveable along a longitudinal axis of the housing, the mandrel including an enlarged diameter portion; and a plurality of expander points radially disposed within the recess of the housing, the expander points being arranged to ride along an outer diameter of the mandrel as the mandrel is received within the lockout tool housing, and to be urged outwardly as the enlarged diameter portion of the mandrel passes through the plurality of expander points;

locating the lockout tool into the subsurface safety valve;

moving the flow tube downward, thereby opening the flapper member; and urging the expander mandrel downward relative to the lookout tool housing, causing the enlarged diameter portion to pass through the plurality of expander points, and thereby causing the expander points to engage an inside diameter of the flow tube such that the expander points expand a diametrical portion of the flow tube into engagement with the non-moveable seat in the safety valve so as to lock the flapper member in the open position.

24. The method of claim 23, wherein the non-moveable seat in the safety valve defines the hard seat for receiving the flapper member when the flapper member is in the closed position.

25. The method of claim 24, wherein the lockout tool is run into the wellbore on a slickline.

26. The method of claim 25, wherein the expander mandrel is urged downwardly by using a set of jars.

27. The method of claim 23, wherein the lockout tool is run into the wellbore using coiled tubing.

28. The method of claim 27, wherein the expander mandrel is urged downwardly by applying hydraulic pressure through the coiled tubing.

29. The method of claim 23, wherein the expander points define balls.

30. The method of claim 23, wherein the expander points define dogs.

31. The method of claim 23, wherein the step of urging the expander mandrel downward is accomplished mechanically.

32. The method of claim 23, wherein the step of urging the expander mandrel downward is accomplished hydraulically.

33. A method for expanding a first tubular body into a surrounding second tubular body, comprising the steps of:

attaching the first tubular to a lockout tool, the lockout tool comprising:

an elongated housing dimensioned to be received within the first tubular, the housing having a bore therethrough, and having a recess;

a mandrel received within the bore of the housing, and being moveable along a longitudinal axis of the housing, the mandrel including an enlarged diameter portion; and a plurality of expander points radially disposed within the recess of the housing, the expander points being arranged to ride along an outer diameter of the mandrel as the mandrel is received within the lockout tool housing, and to be urged outwardly as the enlarged diameter portion of the mandrel passes through the plurality of expander points;

running the first tubular and the attached lockout tool into a wellbore;

urging the mandrel downward relative to the lockout tool housing, causing the enlarged diameter portion to pass through the plurality of expander points, and thereby causing the plurality of expander points to engage an inside diameter of the first tubular such that the expander points expand a diametrical portion of the first tubular into engagement with the second tubular so as to lock the first tubular into frictional engagement with the second tubular at a selected depth.

34. The method of claim 33, further comprising the steps of:

pulling the lockout tool out of the wellbore;

running into the wellbore with an expander tool;

locating the expander tool at a depth in the wellbore adjacent the first tubular;

actuating the expander tool;

translating the expander tool along a desired length within the first tubular, thereby further expanding the first tubular into further frictional engagement with the second tubular.

35. The method of claim 34, wherein the expander tool is a hydraulically actuated, rotary expander tool; and wherein the method further comprises the step of rotating the rotary expander too while translating the expander tool along a desired length within the first tubular.

36. The method of claim 34, wherein the expander points define balls.

37. The method of claim 34, wherein the expander points define dogs.

* * * * *